US005251890A

United States Patent [19]

Sasai

[11] Patent Number: 5,251,890

[45] Date of Patent: Oct. 12, 1993

[54] EJECTED SHEET STACKING TRAY SYSTEM

[75] Inventor: Keizo Sasai, Yokohama, Japan

[73] Assignee: Canon Kabushiki Kaisha, Tokyo, Japan

[21] Appl. No.: 667,578

[22] Filed: Mar. 11, 1991

[30] Foreign Application Priority Data

Mar. 14, 1990 [JP] Japan ..... 2-063342
Mar. 26, 1990 [JP] Japan ..... 2-075939
Mar. 26, 1990 [JP] Japan ..... 2-075940

[51] Int. Cl.[5] ..... B65H 31/22

[52] U.S. Cl. ..... 271/176; 271/189; 271/213

[58] Field of Search ..... 271/213, 291, 189, 218, 271/176

[56] References Cited

U.S. PATENT DOCUMENTS 3,912,389 10/1975 Miyamoto ..... 271/213 X
4,139,191 2/1979 Muller ..... 271/218 X
4,819,930 4/1989 Jackson ..... 271/213 X

FOREIGN PATENT DOCUMENTS 291363 12/1986 Japan ..... 271/213

*Primary Examiner*—Richard A. Schacher
*Attorney, Agent, or Firm*—Fitzpatrick, Cella, Harper & Scinto

[57] ABSTRACT

An ejected sheet stacking tray system comprising a tray or the like shiftable between an operative position where a sheet can be stacked on the tray and an inoperative position, an electrically-operated device for controlling the shifting of the tray, a device for detecting the presence of the sheet on the tray, and an arrangement for controlling the electrically-operated device when the absence of the sheet is detected, shift the tray to the inoperative position.

17 Claims, 29 Drawing Sheets

EJECTED SHEET STACKING TRAY SYSTEM

BACKGROUND OF THE INVENTION

1. Field of the Invention

The present invention relates to an ejected sheet stacking tray system for stacking sheets ejected from a sheet feeding apparatus of a facsimile, copying machine and the like, and more particularly, it relates to an ejected sheet stacking tray system wherein a tray for stacking sheets is retractably formed.

2. Related Background Art

FIG. 1 shows an example of a conventional facsimile system a. In this system, a sheet material P unwound from a sheet roll b is conveyed by a platen c and an image is recorded on the sheet by a thermal head d. Then, the sheet P is cut by a cutter e and is ejected in a direction shown by the arrow A out of the system a. On the other hand, an original M is conveyed by an original roller g. After image information on the original is read by a contact sensor b, the original is ejected through an ejecting outlet i in a direction shown by the arrow B.

A tray j for containing or stacking sheets P is disposed out of the system a and is fixed to the system a by means of screws q in such a manner that it extends from the proximity of a pair of ejecting rollers f below the ejecting outlet i substantially in a horizontal direction to form a dish. The sheets P and the originals M ejected from the system a are stacked on the tray j.

Next, FIG. 2 shows another example of a conventional facsimile system a. In this facsimile system, elements denoted by the same reference numerals as numerals as used in FIG. 1 have same functions as those of the corresponding elements shown in FIG. 1 . However, in this example, the system a is rested on a support r having a height larger than that of a tray k and the tray k is fixed to the system a by means of screws q to form a basket below a pair of ejecting rollers f.

However, in the above-mentioned conventional examples, since the trays j and k always protrude from the system a greatly, a large installation space for the system a is required, and it is difficult to handle and transport the system a due to the obstruction of the trays j and k. Further, it is difficult to align or register leading ends of the ejected sheets P with each other, which may disorder the pages of the sheets. In addition, if the trays j and k are of removable type, since there is no storing space for the trays, it is feared that the trays are lost or missing.

In the conventional example shown in FIG. 2, although the tray k is not protruded in the horizontal direction so much, the support r having the height greater than that of the tray is required. Further, if an office desk is used as the support r, there arises a problem that drawers of the desk cannot be used. In addition, the trays k and j fixed to the system a defile the appearance of the system.

In particular, since OA (office automation) equipments have recently been progressed and they are frequently installed in rooms where persons work, the protruded trays obstruct the persons' way and defile the appearance of the systems, with the result that there arises a problem that such inconvenient OA equipments are kept at a respectful distance from users.

In order to solve the above-mentioned problems, there has been proposed a technique that the tray k is of removable or retractable type. This technique is effective to save the installation space of the system. However, since the stacking space or width of the tray is relatively small, the tray cannot receive a large number of ejected sheets P, and, since the tray k is designed to support the sheets P in such a way that the leading ends of the sheets are abutted against of the bottom of the tray, if a large number of elongated sheets P are stacked in the tray, there arises a problem that some sheets cannot be received in the tray to drop out of the tray.

SUMMARY OF THE INVENTION

The present invention aims to eliminate the above-mentioned conventional drawbacks, and has an object to provide an ejected sheet stacking tray system which can save an installation space for the system.

In order to achieve the above object, the present invention provides an ejected sheet stacking tray system characterized in that a tray is telescopically or retractably supported with respect to the system and the tray can be used in an extended condition at need.

According to the above characteristics, since the tray is retracted within the system when it is not used, the tray does not obstruct the person's way and saves an installation space for the system.

Further, after a leading end of a sheet ejected from a sheet feeding apparatus is held in a first tray, by stacking the sheet in a second tray supported in a vacant space, it is possible to stack a large number of sheets which are difficult to be stably stacked only by the first tray, without fail.

Furthermore, since the second tray can be retracted into the vacant space when the second tray is not used, it is possible to save the space for the sheet feeding apparatus, with the result that the saved space can be effectively utilized, and, since there is no protruded tray, the appearance of the system is not defiled.

Incidentally, by facilitating the selection of proper use of the first and second trays, it is possible to assume the optimum sheet containing condition under all circumstances.

Further, by protruding the tray by a predetermined amount in synchronous with the timing that the sheet is ejected from the sheet feeding apparatus so that the sheets can be received in the tray, an operator does not need to pay attention to protrude or extend the extracted tray, thus preventing the accidental dropping of the sheet. In addition, since the tray can be extended automatically to accommodate the length of the sheet, it is possible to stack the sheets on the tray stably and to reduce the installation space required for the system.

Furthermore, by automatically protruding the tray when the sheet is ejected from the sheet feeding apparatus and by automatically retracting the tray when the sheets are removed from the tray, it is possible to prevent the accidental dropping of the sheet, since, if the operator forgets to extend the tray, the latter is automatically extended.

DETAILED DESCRIPTION OF THE PREFERRED EMBODIMENTS

The present invention will now be explained in connection with embodiments thereof with reference to the accompanying drawings.

Figure 1:
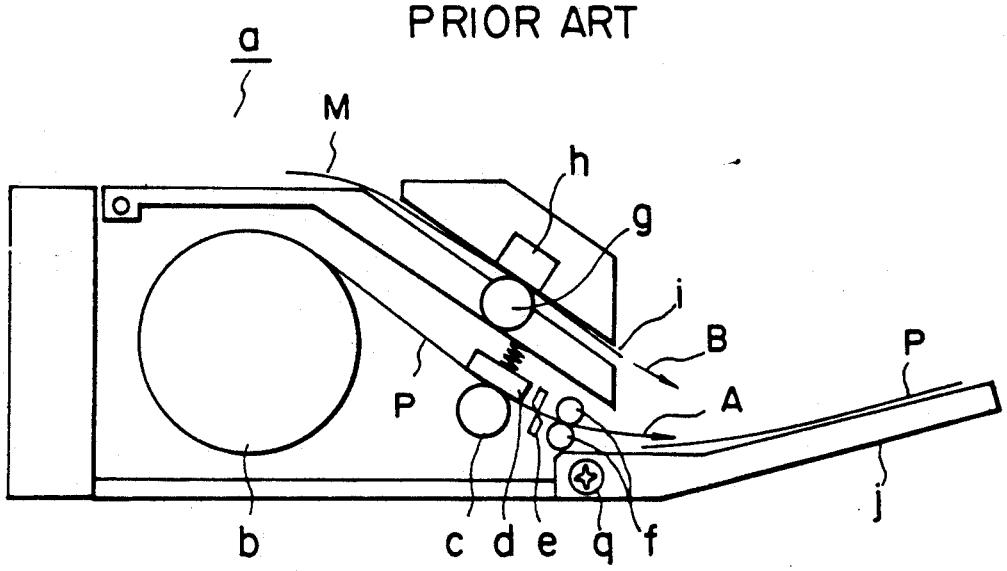
FIG. 1 PRIOR ART
FIG. 1 is an elevational sectional view of a conventional facsimile system.
Figure 2:
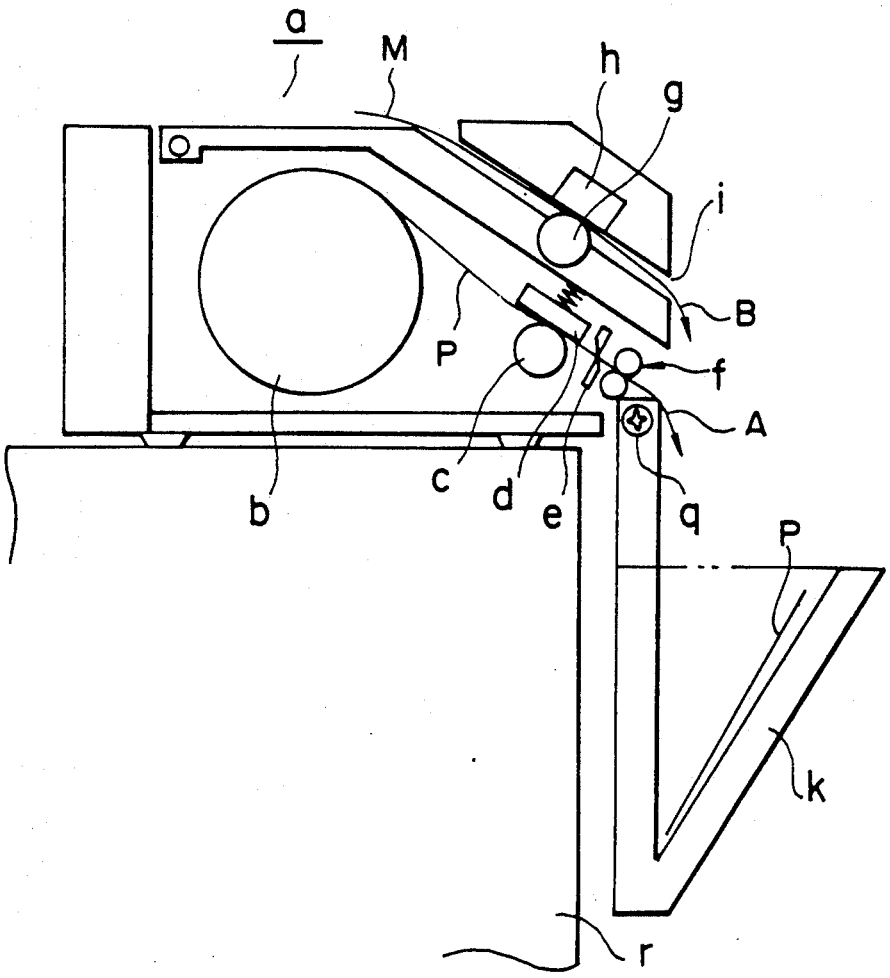
FIG. 2 PRIOR ART
FIG. 2 is an elevational sectional view of another conventional facsimile system.
Figure 3:
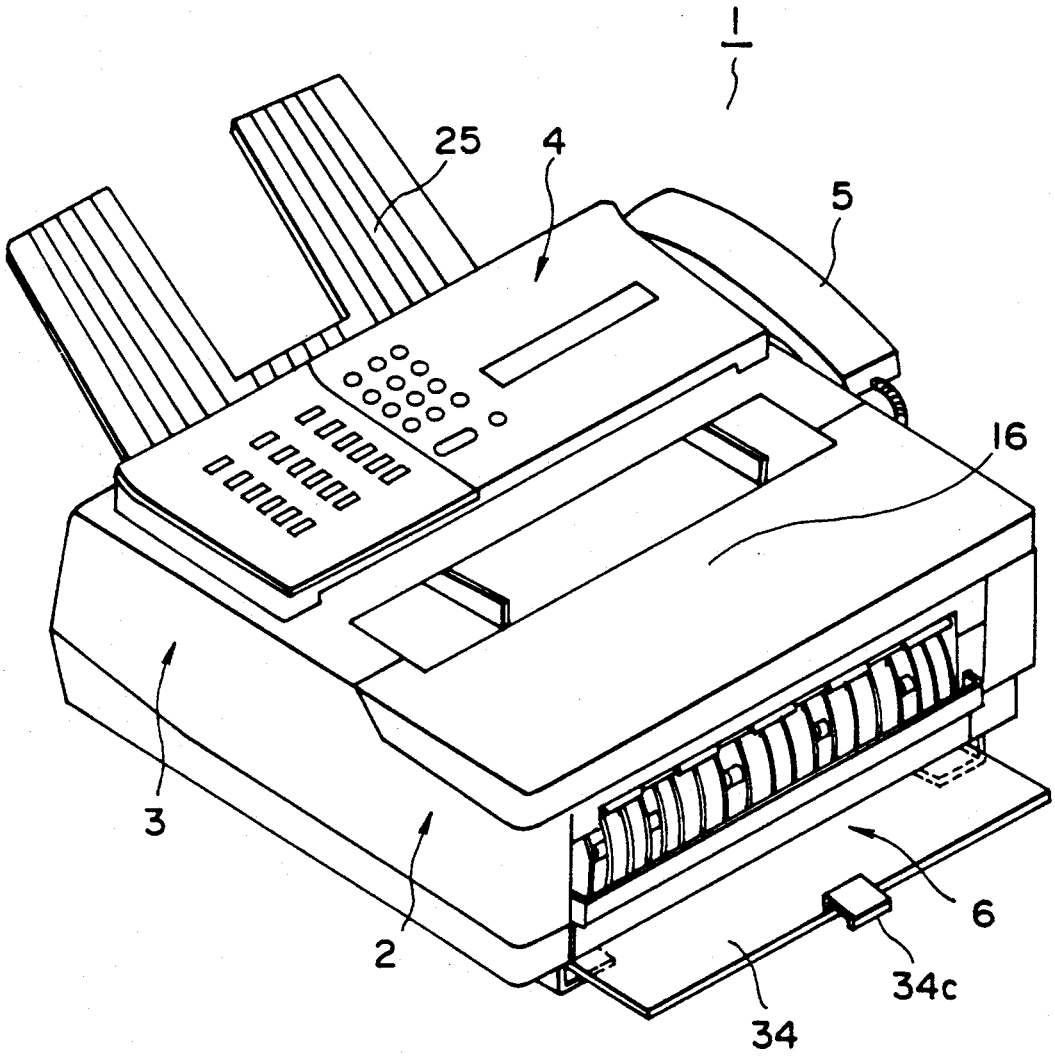
FIG. 3 is a perspective view of a facsimile incorporating an ejected sheet stacking tray system according to a preferred embodiment of the present invention.
Figure 4:
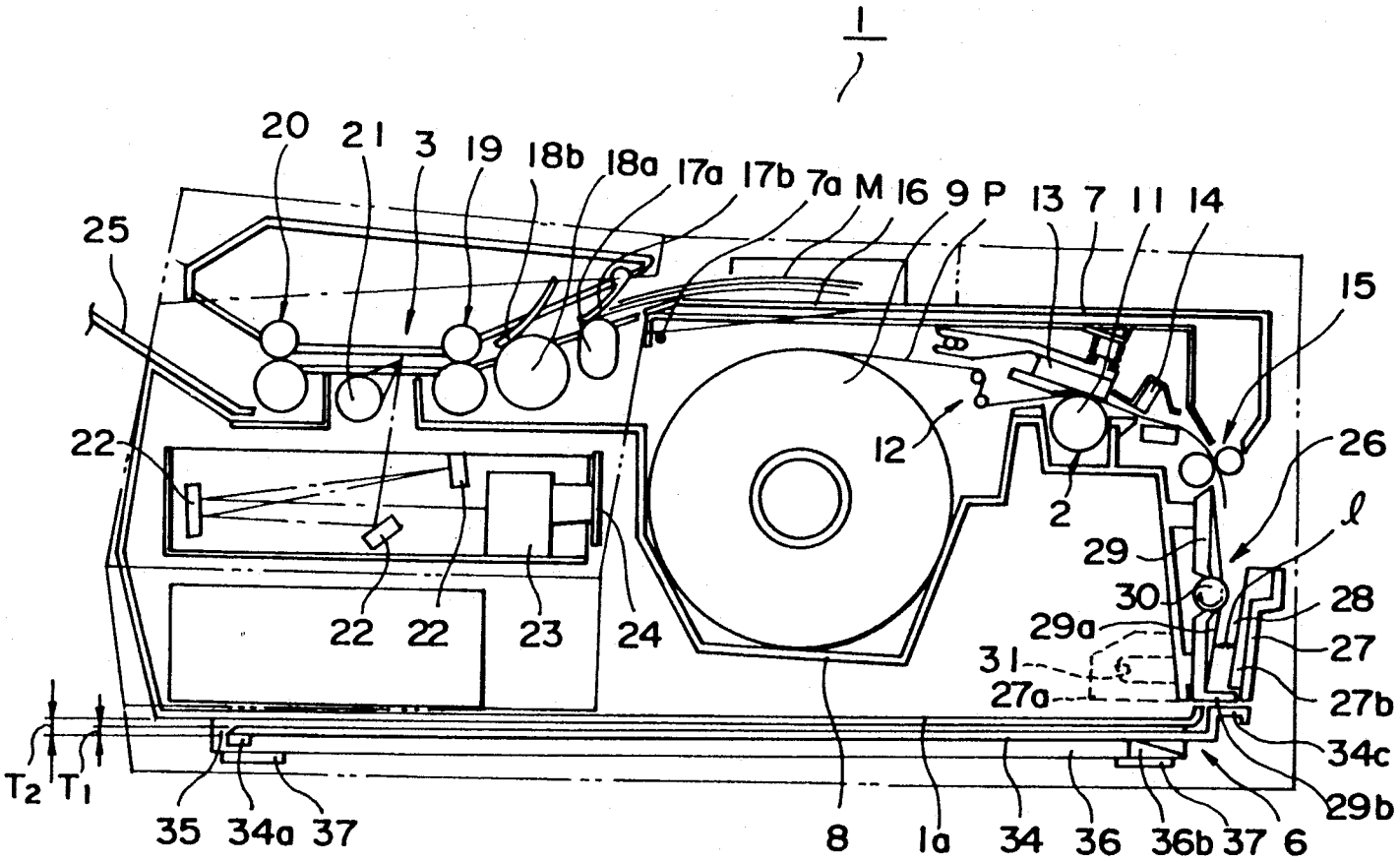
FIG. 4 is an elevational sectional view of the facsimile of FIG. 3.

In FIGS. 3 and 4, a facsimile 1 is provided at its front part with a recording portion 2 and is also provided at its rear part with an original reading portion 3. An operation panel 4 is disposed on an outer surface of the facsimile above the original reading portion 3, a telephone 5 is arranged at the right side of the original reading portion 3, and a sheet stacking system 6 is disposed on a front end of the facsimile at the bottom thereof.

Next, the recording portion 2 will be explained.

A lid 7 is pivotally or openably mounted a frame 1*a* of the facsimile 1 via a pivot pin 7*a* and is normally locked with respect to the frame 1*a* by means of a click mechanism (not shown).

Further, a roll holder 8 is arranged within the frame 1*a* below the lid 7 and a roll of heat-sensitive sheet P (sheet roll) is mounted on the holder 8. The heat-sensitive sheet P is conveyed by the rotation of a platen roller 11. When the sheet is passing through a de-curl mechanism (curl correcting mechanism) 12, the sheet is flexed or bent in a direction opposite to a curled direction, thus correcting the curled condition of the sheet. Then, a predetermined image is recorded on the sheet P by a recording means 13, and. thereafter, the sheet is cut by a cutter 14 and is ejected by ejecting rollers 15.

Next, the original reading portion 3 will be explained.

A plurality of originals M are set on an original support 16 formed on an upper surface of the lid 7. When the reading operation is started, several originals M are picked up from the stacked originals (original stack) from the bottom thereof by means of a pre-supply roller 17*a* and a pressure member 17*b* pressed against the roller 17*a*. Then, the original is separated and fed one by one by means of a separating roller 18*a* and a pressure member 18*b* pressed against the separating roller. Further, while the original M is being conveyed by pairs of conveying rollers 19, 20, the light from a light source 21 is illuminated on the original. The light reflected from the original is sent, via mirrors 22 and a lens 23, to a photo-electric conversion element 24 such as a CCD, where the light is converted into an electric signal. When a copy mode is selected, in response to this electric signal, an image is recorded on the sheet P by the recording means 13.

On the other hand, when a facsimile mode is selected, the electric signal is transmitted to a recording portion of another facsimile.

Incidentally, when the reading operation is finished, the original M is ejected onto an original tray 25 arranged at a left end of the facsimile 1 and extending outwardly and upwardly therefrom.

Figure 5:
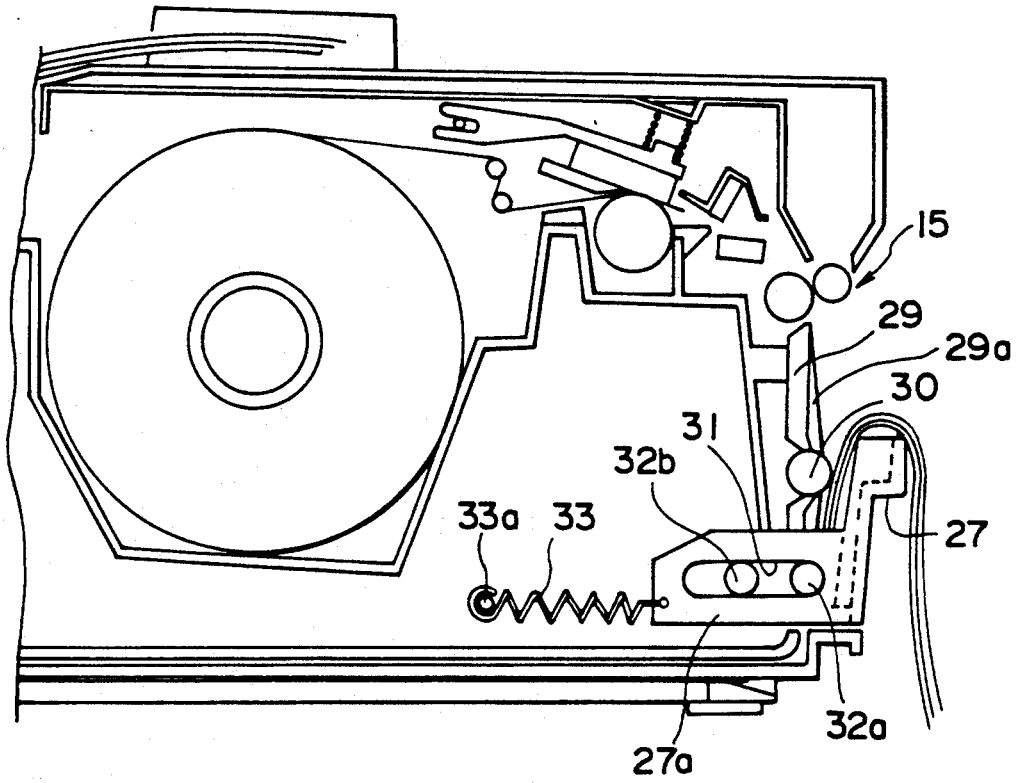
FIG. 5 is an elevational sectional view of a part of the facsimile of FIG. 3, showing the construction of a first tray.

Next, the sheet stacking system 6 will be explained with reference to FIGS. 4 and 5.

First of all, a first tray 26 comprises an outer guide 27 for directing a leading end of the ejected sheet P donwwardly, an inner guide 29 opposed to the outer guide 27 to define a sheet stacking cavity 28 therebetween, and a gripping roller 30. The outer guide 27 is provided at its both sides with a pair of brackets 27*a* at a lower end thereof, which brackets have horizontal slots 31 formed therein. Rollers 32*a*, 32*b* rotatably mounted on the frame 1*a* for guiding the outer guide in a horizontal direction are received in the slots 31 of the brackets 27*a*. When the brackets 27*a* are abutted against the roller 32*a*, the outer guide 27 is positioned at an innermost position; whereas, when the brackets are abutted against the roller 32*b*, the outer guide is positioned at an outermost position. Tension springs 33 are connected between pins 33*a* formed on the frame 1*a* and the brackets 27*a* to bias the outer guide 27 inwardly.

The inner guide 29 is fixed to the frame 1*a*, and the gripping roller 30 is rotatably mounted on an intermediate portion of the inner guide in such a manner that it is rotated substantially in synchronous with the ejecting rollers 15. Incidentally, on opposed surfaces of the outer guide 27 and the L-shaped inner guide 29, a respectively. A distance between the ribs 27*b* and 29*a* is shown as l in FIG. 4. This distance l, i.e., a width of the stacking cavity 28 can be varied from a minimum width $l_o$ to a maximum width $l_m$ in accordance with the relation between the rollers 32*a*, 32*b* and the slots 31. Further, a bottom of the L-shaped inner guide 29 defines a sheet receiving portion 29*b*.

Incidentally, the sheet P ejected from the ejecting rollers 15 is oriented to be inserted into the clearance l, and a sufficient space is maintained between the ejecting rollers and the sheet stacking cavity.

Next, a second tray 34 and a recessed portion 35 for containing the second tray will be explained with reference to FIGS. 6 and 7.

A pair of guide rails 36 are formed on an under surface of the bottom of the frame 1*a* in parallel therewith. A width or distance $W_3$ between bottom members of the guide rails 36 is selected to be smaller than a width $W_1$ of the second tray 34 so that the second tray 34 can be rested on the rails, and a width or distance $W_2$ between longitudinal members 36*a* of the guide rails 36 is selected to be slightly greater than the width $W_1$ of the second tray 34. The guide rails 36 are attached to the bottom of the frame 1*a* through the longitudinal members, and legs 37 made of rubber and the like are attached to the bottom of the guide rails 36.

The recessed portion 35 is defined by a space surrounded by the bottom and longitudinal members of the guide rails and the bottom of the frame 1*a* and has a width $W_2$, length $L_2$ and height $T_2$.

Further, the second tray 34 has the width $W_1$, length $L_1$ and height (thickness) $T_1$, which are smaller than those of the recessed portion 35, so that the tray can completely be inserted into the recessed portion 35, so that the tray can completely be inserted into the recessed portion 35. At the left end of the second tray 34, on an undersurface thereof, there are provided projections 34*a* which are positioned at a distance slightly smaller than the distance $W_3$ between the bottom members of the guide rails 36. Further, on the inner surfaces of the bottom members of the guide rails 36 at its intermediate portions, there are formed click portions 36*a* directing inwardly. The projections 34*a* serve to guide the second tray 34 along the guide rails 36 and are adapted to be engaged by the corresponding clicks 36*a*. Further, projections 36*b* directing inwardly are formed on the corresponding bottom members of the guide rails 36 at their front ends, which projections can lock the projections 34*a* of the second tray 34.

In addition, an inclined surface 34*b* is formed on a left (rear) upper corner of the second tray 34, and an inclined surface 36*c* is formed at a right (front) upper corner of each guide rail 36. Further, a grip 34*c* extending upwardly is formed on the front end of the second tray 34 at its intermediate portion.

Next, an operation that the heat-sensitive sheets P are stacked on the first tray 26 will be explained with reference to FIGS. 8 and 9.

First of all, when only the first tray 26 is used, the leading end of the sheet P ejected by the ejecting rollers 15 is guided by the ribs 27*b*, 29*a* and then is conveyed by a friction force between the sheet and the gripping roller 30 until the leading end of the sheet (shown as a sheet Pa) is abutted against the sheet receiving portion 29*b* of the stacking cavity 28 having the width of $l_o$.

Further, when the sheet is ejected by the ejecting rollers 15, the sheet is under a condition that the leading end of the sheet is abutted against the sheet receiving portion 29*b* shown as a sheet Pb. Then, after the sheet is cut by the cutter 14, when a trailing end of the sheet P leaves the ejecting rollers 15, the sheet falls by its own weight to assume a condition as shown by a sheet Pc and then to assume a condition as shown by a sheet Pd and at last to reach a condition as shown by a sheet Pf, where the trailing end of the sheet hangs down out of the facsimile. In this condition, the leading end of the sheet is held by the friction force between the sheet and the ribs 29*a*, gripping roller 30 and ribs 27*b*. Incidentally, since the gripping roller 30 is made of rubber, the friction force between this roller and the sheet is great, thus positively holding the sheet Pf.

Then, when a second sheet P is ejected, the second sheet is overlapped with the first sheet P. By ejecting further sheets continuously, when the width $l_o$ of the cavity 28 is fully coupled by the sheets, a next sheet is forcibly pushed between the gripping roller 30 and the lastly ejected sheet P by the friction force of the gripping roller 30 rotated substantially in synchronous with the ejecting rollers 15. In this way, the tension springs 33 are extended to increase the pulling force thereof, i.e., to increase the contacting pressure between the sheet P and the gripping roller 30, thus increasing a sheet conveying force of the gripping roller 30, with the result that a large number of sheets can be stacked in the cavity 28 gradually increasing its width l, with the leading ends of the sheets abutted against the sheet receiving portion 29*b*.

Next, an operation that the heat-sensitive sheets P are stacked on the second tray 34 will be explained with reference to FIGS. 7, 10 and 11.

Figure 11:
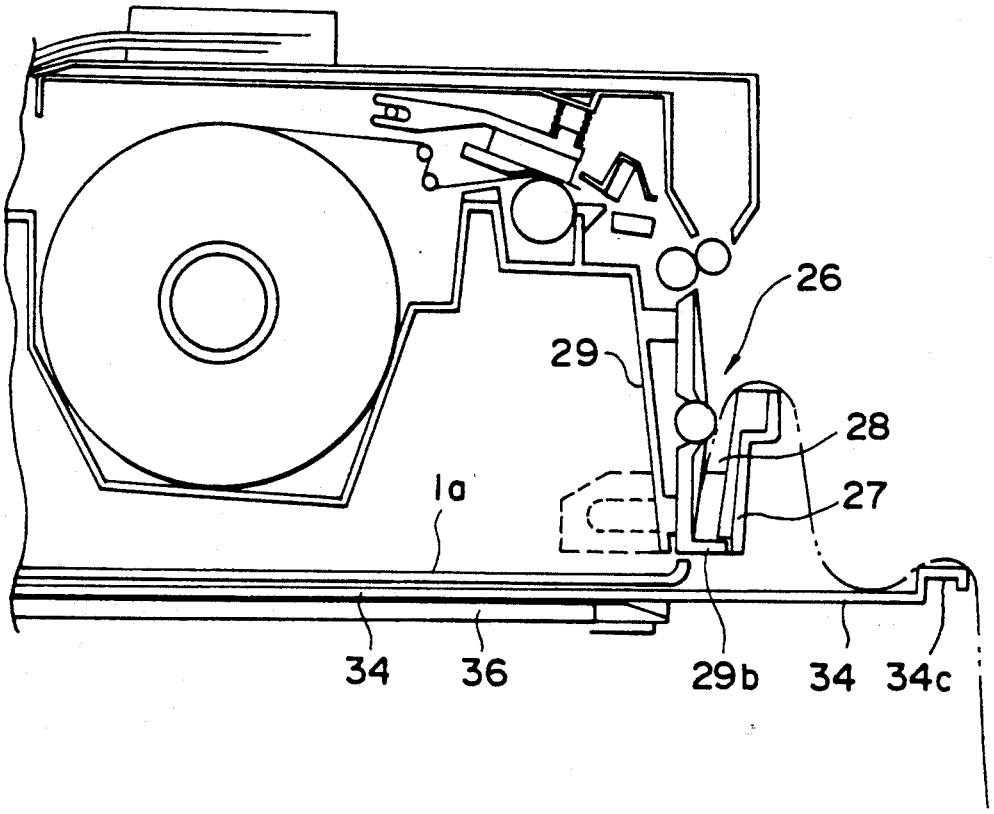
FIG. 11 is an elevational sectional view of a part of the facsimile, showing a condition that a sheet is stacked on the second tray which is extended at a smaller extent.

First of all, when the operator pulls the second tray 34 through the grip 34*c*, as shown in FIG. 11, even in an intermediate condition, the second tray 34 is supported by the recessed portion 35 substantially in a horizontal state. Further, FIG. 7 shows a condition that the tray 34 was pulled out or drawn until the projections 34*a* of the tray 34 are engaged by the clicks portions 36*a*.

Figure 6:
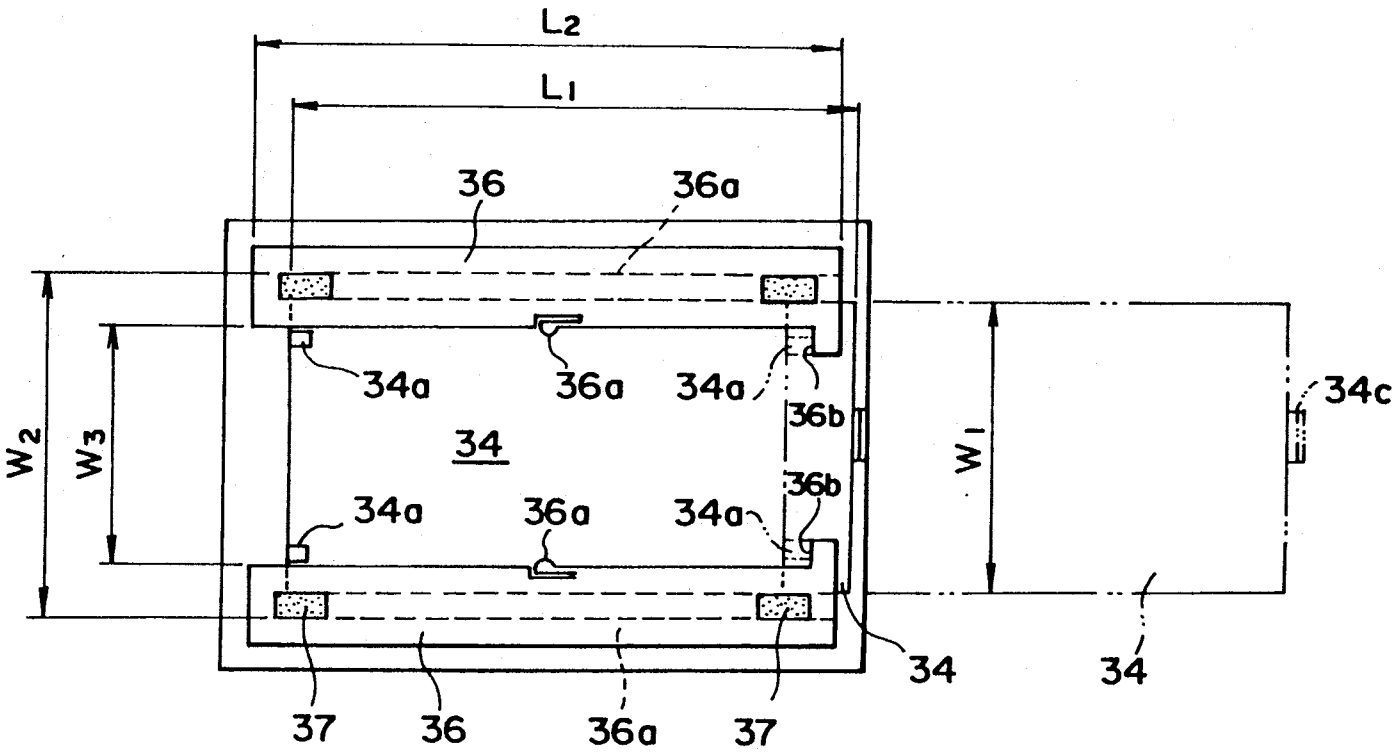
FIG. 6 is a bottom view of the facsimile, showing the construction of a second tray.

When the tray 34 is pulled out until the projections 34*a* formed on the left end of the tray 34 are locked by the projections 36*b* of the guide rails 36 as shown by the phantom line in FIG. 6, the inclined surface 34*b* of the tray 34 is abutted against the undersurface of the frame 1*a* and the undersurface of the tray 34 is abutted against the inclined surfaces 36*c* of the guide rails 36, with the result that the tray 34 is inclined by an angle $\theta$, thus setting the tray 34.

Figure 10:
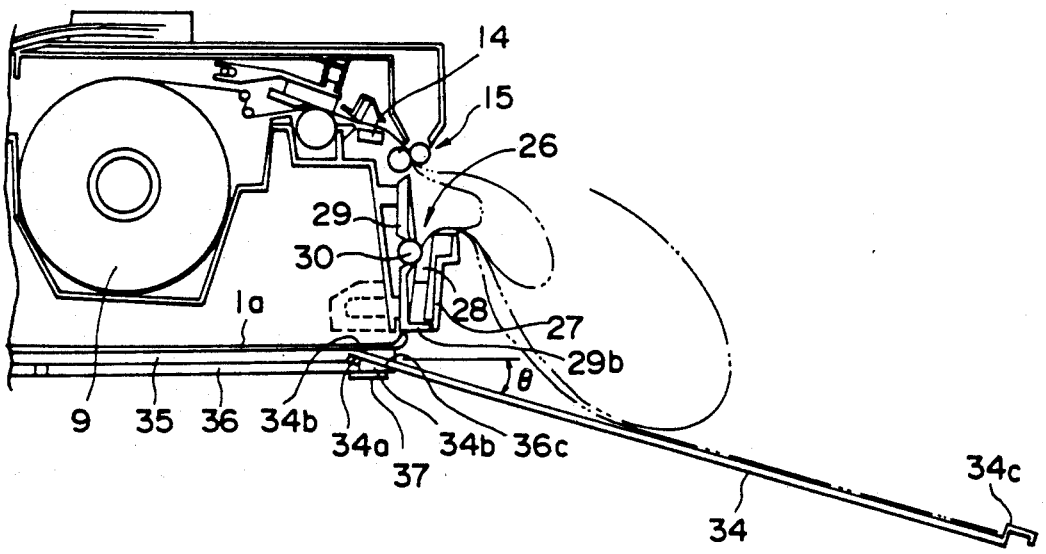
FIG. 10 is an elevational sectional view of a part of the facsimile, showing a condition that a sheet having the maximum size is stacked on the second tray.

For example, when the sheet roll 9 having a width of B4 size is used, as shown in FIG. 10, the leading end of the sheet P cut to have a length of B4 size is held in the stacking cavity 28 of the first tray 26. And, when the trailing end of the sheet is rested on the second tray 34 in the vicinity of the grip 34*a*, the sheet of B4 size is rested on the second tray 34 regularly. When the second tray 34 is set as shown in FIG. 7, the sheets P cut to have a length of A4 size are rested on the second tray in the same manner as described above.

Incidentally, when various sheets having different sizes are used, the positions of various click portions may be selected accordingly.

Further, as shown in FIG. 11, in order to rest the sheets P on the second tray 34, the latter may be pulled out by a distance smaller than the distance corresponding to the length of the sheet P. In this case, since the leading end of the sheet P is held in the first tray 26, so long as only a portion of the sheet is contacted with the second tray 34, the sheet will be rested more stably. Thus, it is not necessary to pull out the second tray 34 more than needed, thus saving the required space for the facsiimle 1.

Figure 7:
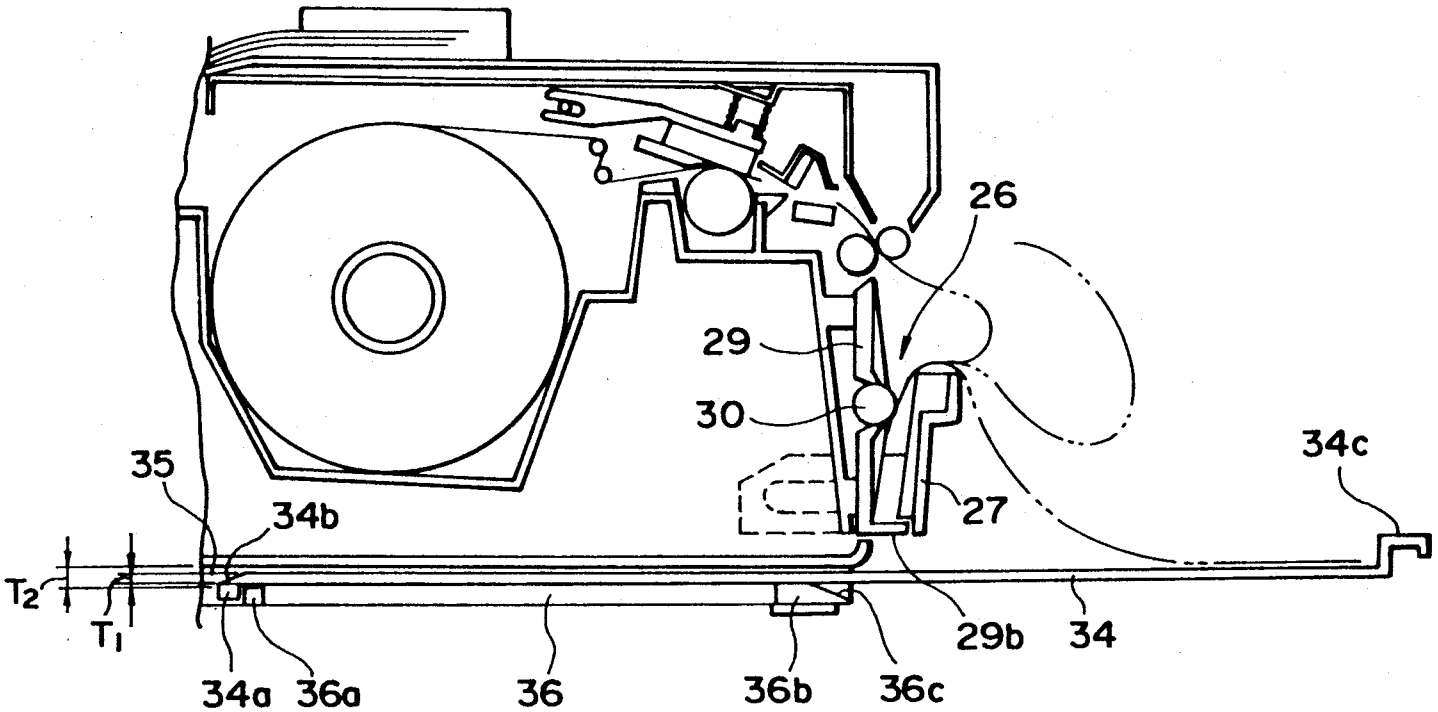
FIG. 7 is an elevational sectional view of a part of the facsimile, showing a condition that a sheet having an intermediate size is being stacked on the second tray.
Figure 8:
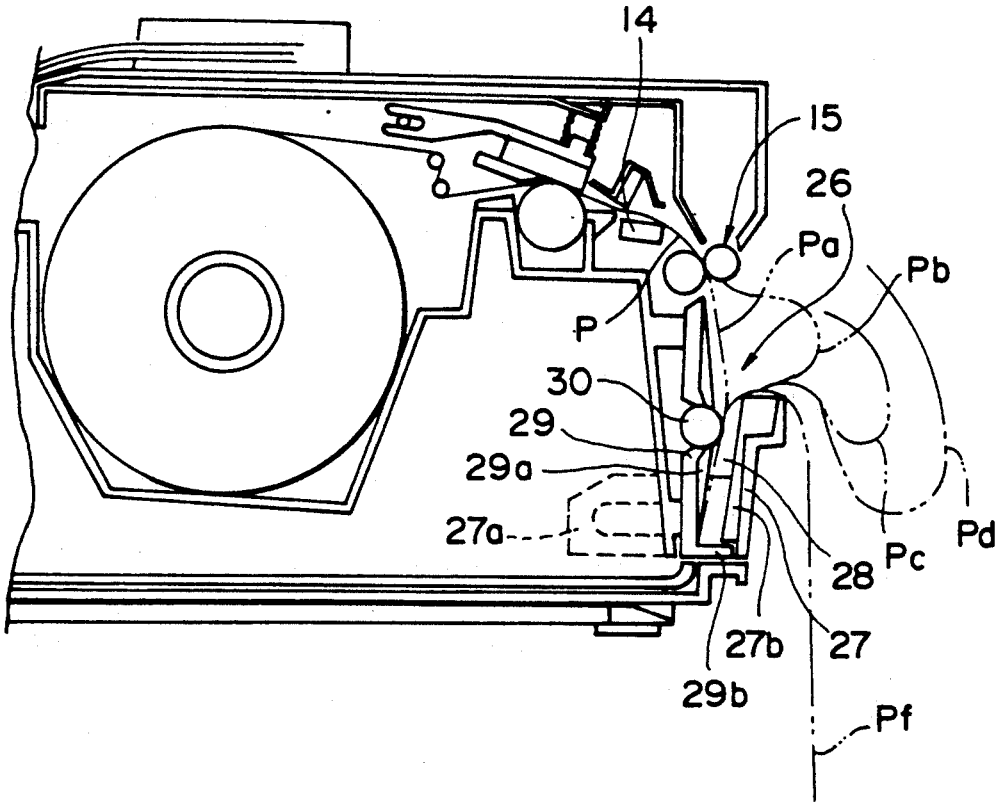
FIG. 8 is an elevational sectional view of a part of the facsimile, showing a condition that a sheet is being stacked on the first tray.
Figure 9:
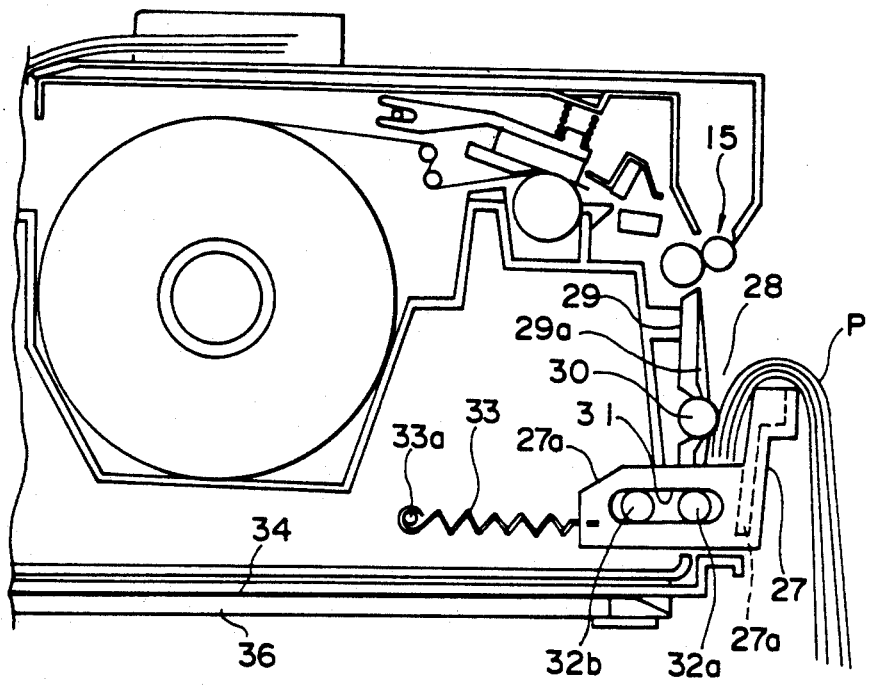
FIG. 9 is an elevational sectional view of a part of the facsimile, showing a condition that a number of sheets are stacked on the first tray.

Incidentally, the phantom lines shown in FIGS. 7 and 10 show sequential conditions of the sheet until it is rested on the second tray, as similar to those showing the sequential conditions of the sheet until it is stacked in the first tray 26 in FIG. 8.

The above-mentioned second tray is not limited to a plate member made of plastic material, but may be formed by bending wires, for example. Further, the guide rails 36 may be integrally formed with the bottom of the frame 1*a*.

Figure 12:
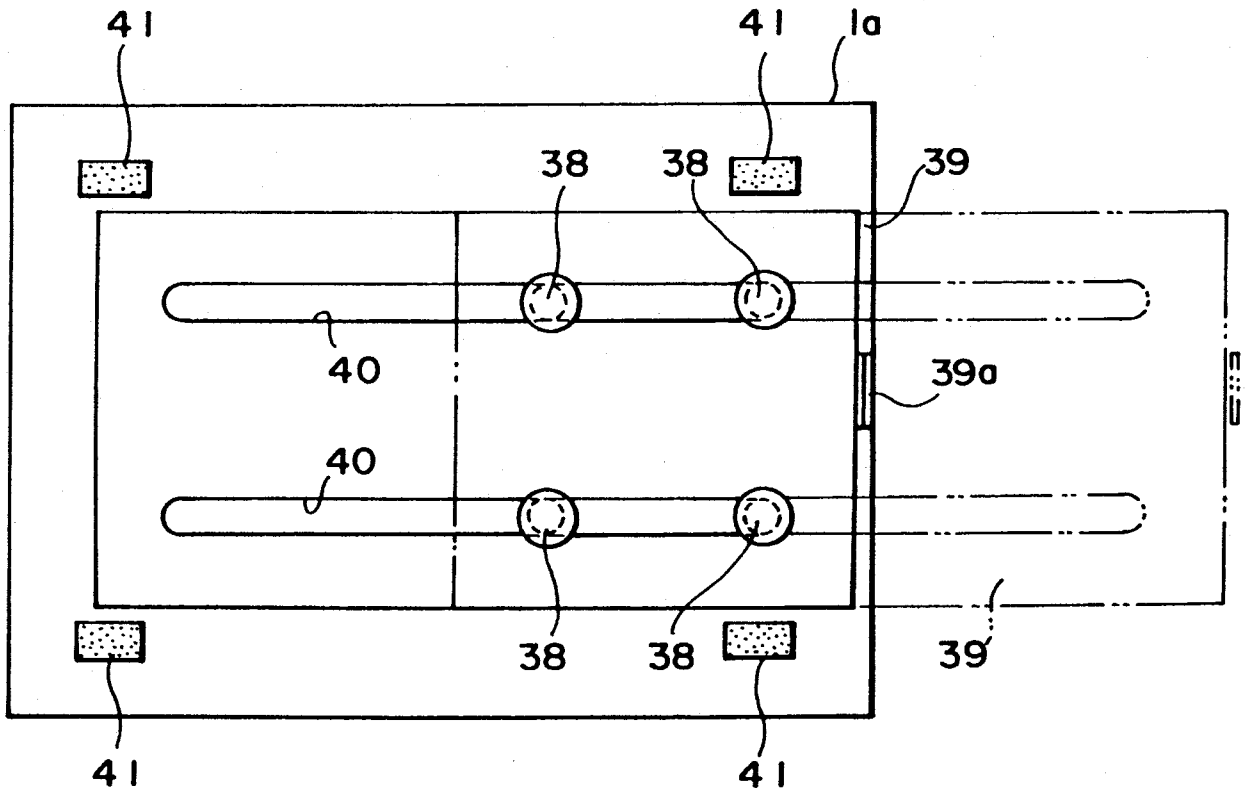
FIG. 12 is a bottom view showing a second embodiment of the present invention.

Next, a second embodiment of the present invention will be explained with reference to FIG. 12.

In this embodiment, four stepped pins 38 are fixedly mounted on the bottom of the frame 1*a* and are arranged in two rows (each including two stepped pins) extending to a longitudinal direction of the frame. And, slots 40 formed in a second tray 39 and extending to a longitudinal direction of the second tray are guided by the corresponding stepped pins 38. Further, legs 41 each having a height greater than the thickness of the second tray 39 and the lengths of the stepped pins 38 are attached to the bottom of the frame 1*a* at the outside of the second tray 39.

In this way, a recessed portion for containing the second tray 39 is defined by a space between the bottom of the frame 1*a* and an upper surface of a support for the facsimile and inside the legs 41. The tray 39 has a grip 39*a*.

This second embodiment has the same function and technical effects as those of the previous first embodiment.

Figure 13:
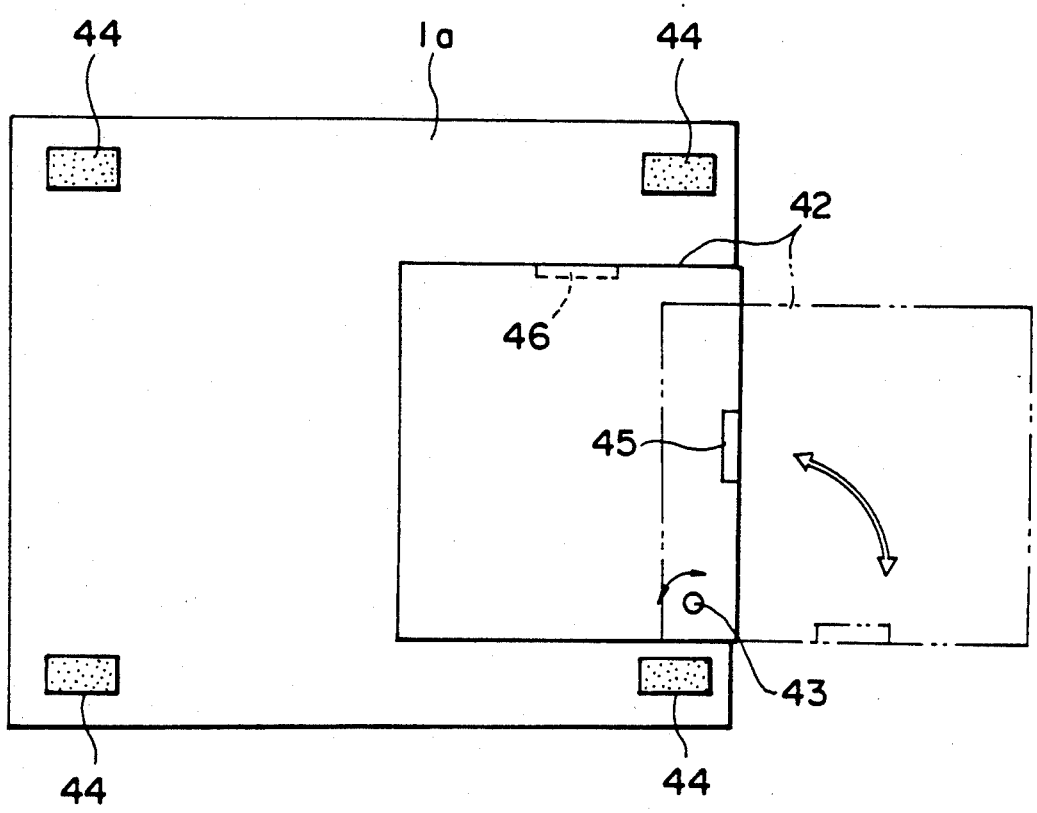
FIG. 13 is a bottom view showing a third embodiment of the present invention.
Figure 14:
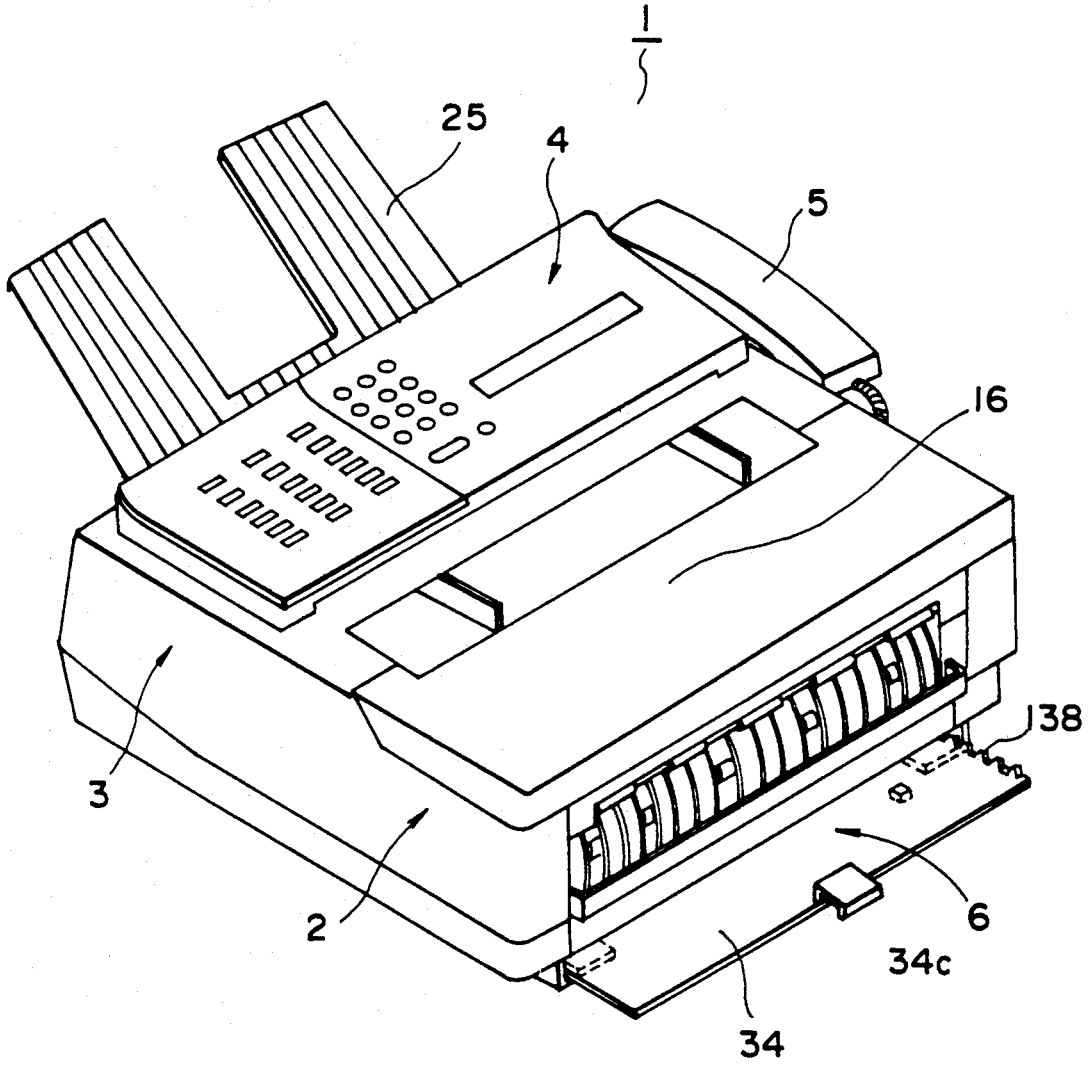
FIG. 14 is a perspective view of a facsimile incorporating an ejected sheet stacking tray system according to a fourth embodiment of the present invention.

Next, a third embodiment of the present invention will be explained with reference to FIG. 13.

In this third embodiment, a second tray 42 is pivotally mounted, at its one corner, on the bottom of the frame 1*a* via a pin 43 formed on the bottom of the frame, and legs 44 each having a length greater than the length of the pin 43 and the thickness of the tray 42 are formed on the bottom of the frame 1*a* with all possible extent. Incidentally, the reference numeral 45 denotes a grip carried by the tray 42; and 46 denotes a stopper (side hold-down member) for the sheet P.

With this arrangement, when the second tray 42 is used, it is rocked around the pin 43 to reach an extended position as shown by the phantom line; of course, when it is not used, it is retracted to a retracted position a shown by the solid line. Incidentally, in this embodiment, while the length of the tray 42 is limited in comparison with the length of the second tray 34 shown in the above-mentioned second embodiment, since, as mentioned above, the length of the second is not so important for resting the sheets P thereon as much, the same function and technical effects as those of the previous embodiments can be obtained.

Next, examples (fourth and fifth embodiments) that a sheet stacking tray system is operated in synchronous with the rotation of the ejecting rollers will be explained with reference to FIGS. 14 to 23. Incidentally, elements or members shown in these Figures as those shown in FIGS. 3 to 13 are designated by the same reference numerals, and the explanation thereof will be omitted.

In a fourth embodiment (FIGS. 14 to 20), both lateral sides of the second tray 34 are guided between the longitudinal members of the guide rails 36. A rack 138 is formed on the second tray 34 along one of the lateral sides thereof, with which a pinion 139 rotatably mounted on the frame 1*a* is meshed, and a pulley 139*b* is connected to the pinion 139 through an electro-magnetic clutch 139*a*. On the other hand, a motor 140 attached to the frame 1*a* has a motor shaft to which a pulley 140*a* is attached, and a pulley 15*c* is fixedly connected to a drive roller 15*a*constituting one of the ejecting rollers 15. And, these pulleys 15*c*, 139*b* and 140*a* are connected to each other by means of a belt 160 in such a manner that the pulley 139*b* is rotated in the same direction as the pulley 140*a* and the pulley 15*c* is rotated in a direction opposite to those of the pulleys 139*b*, 140*a*.

Further, at the left end of the second tray 34, on an undersurface thereof, there are provided projections 34*a* which are positioned at a distance slightly smaller than the distance $W_3$ between the bottom members of the guide rails 36. Further, projections 36*b* directing inwardly are formed on the corresponding bottom members of the guide rails 36 at their front ends, which projections can lock the projections 34*a* of the second tray 34.

In addition, an inclined surface 34*b* is formed on a left (rear) upper corner of the second tray 34, and an inclined surface 36*c* is formed at a right (front) upper corner of each guide rail 36. Further, a grip 34*c* extending upwardly is formed on the front end of the second tray 34 at its intermediate portion. Furthermore, a sensor 141 for detecting the presence of the sheet P is provided on the upper surface (sheet supporting surface) of the second tray 34 at its front part.

Figure 20:
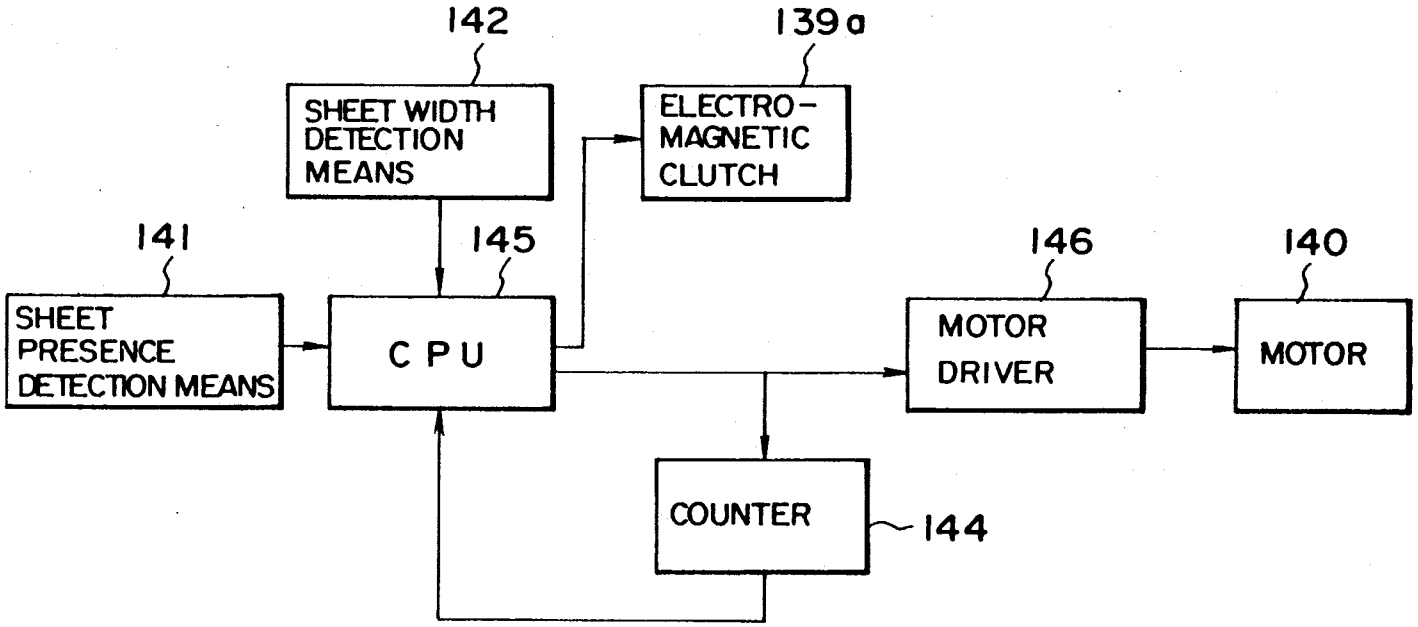
FIG. 20 is a control block diagram.

Next, a control mechanism will be explained with reference to FIG. 20.

Signals from the sensor (sheet presence detection means) 141, a sheet width detection means 142 and a counter 144 for counting the number of revolutions of the motor 140 are sent to a CPU 145. In response to these signals, the CPU 145 energizes the motor 140 for driving the second tray through a motor driver 146 and controls the engagement and disengagement of the electro-magnetic clutch 139*a*.

Next, an operation that the heat-sensitive sheets P are stacked on the first tray 26 will be explained.

Figure 15:
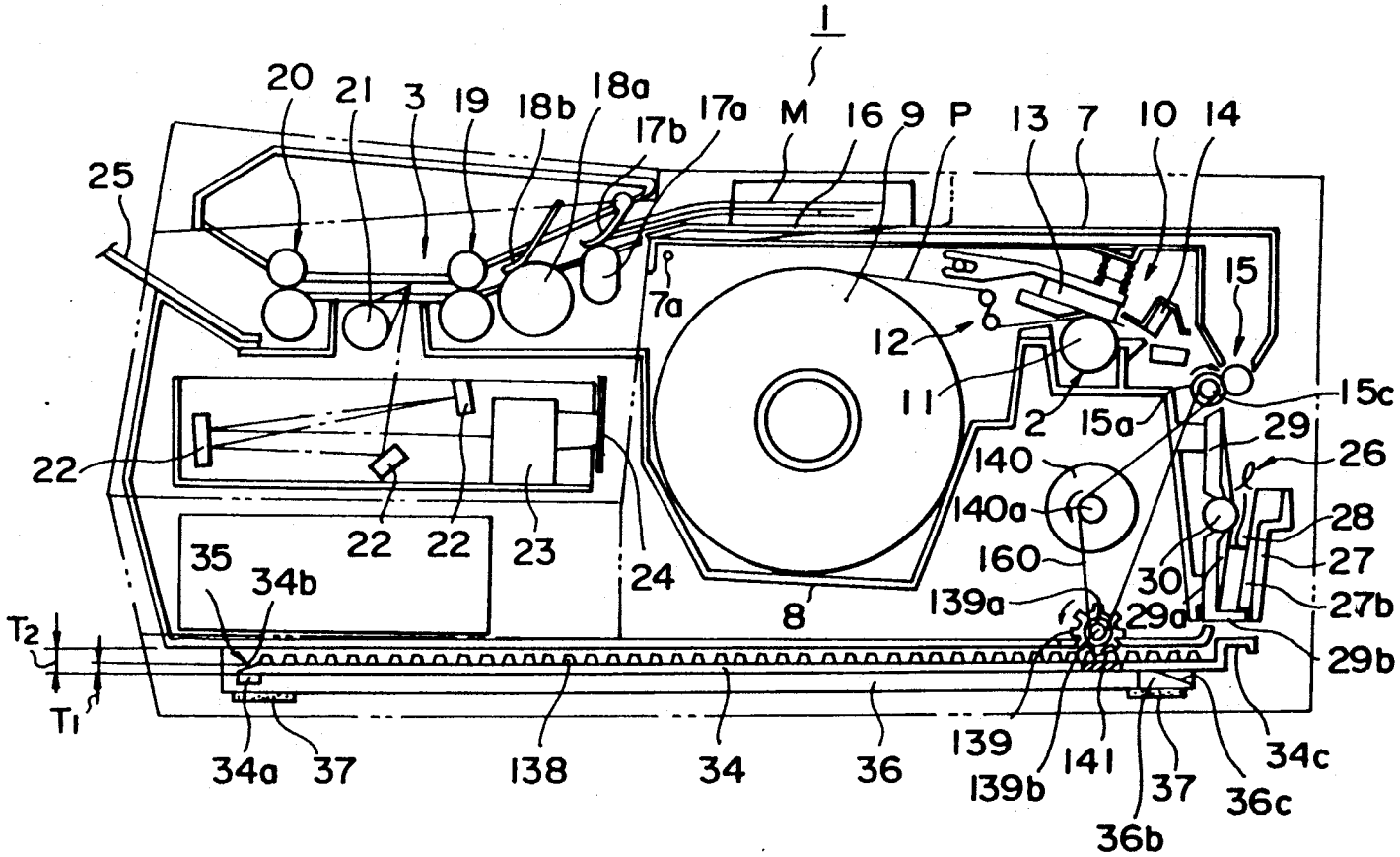
FIG. 15 is an elevational sectional view of the facsimile of FIG. 14.

First of all, when only the first tray 26 is used, the leading end of the sheet P ejected by the ejecting rollers 15 is guided by the ribs 27*b*, 29*a* and then is conveyed by a friction force between the sheet and the gripping roller 30 until the leading end of the sheet (shown as a sheet Pa) is abutted against the sheet receiving portion 29*b of the stacking cavity 28 having the width of* $l_o$, as shown in FIG. 15.

Further, when the sheet is ejected by the ejecting rollers 15, the sheet is under a condition that the leading end of the sheet is abutted against the sheet receiving portion 29*b* shown as a sheet Pb. Then, after the sheet is cut by the cutter 14, when a trailing end of the sheet P leaves the ejecting rollers 15, the sheet falls by its own weight to assume a condition as shown by a sheet Pc and at last to reach a condition as shown by a sheet Pe, where the sheet is rested on the second tray 34. In this condition, the leading end of the sheet Pe is held by the friction force between the sheet and the ribs 29*a*, gripping roller 30 and ribs 27*b*. Incidentally, since the gripping roller 30 is made of rubber and the like, the friction force between this roller and the sheet is great, thus positively holding the sheet Pe.

Then, when a second sheet P is ejected, the second sheet is overlapped with the first sheet P. By ejecting further sheets continuously, when the width $l_o$ of the cavity 28 is fully occupied by the sheets, a next sheet is forcibly pushed between the gripping roller 30 and the lastly ejected sheet P by the friction force of the gripping roller 30 rotated substantially in synchronous with the ejecting rollers 15. In this way, the tension springs 33 are extended to increase the pulling force thereof, i.e., to increase the contacting pressure between the sheet P and the gripping roller 30, with the result that a large number of sheets can be stacked in the cavity 28 gradually increasing its width l, with the leading ends of the sheets abutted against the sheet receiving portion 29*b*.

Next, an operation that the heat-sensitive sheets P are stacked on the second tray 34 will be explained with reference to FIGS. 15 to 20.

The second tray 34 is pulled out or retracted by activating the motor 140 by any amount between a position where the second tray is contained in the recessed portion 35 as shown in FIG. 15 and a position where the projections 34*a* are abutted against the projections 36*b*.

Figure 16:
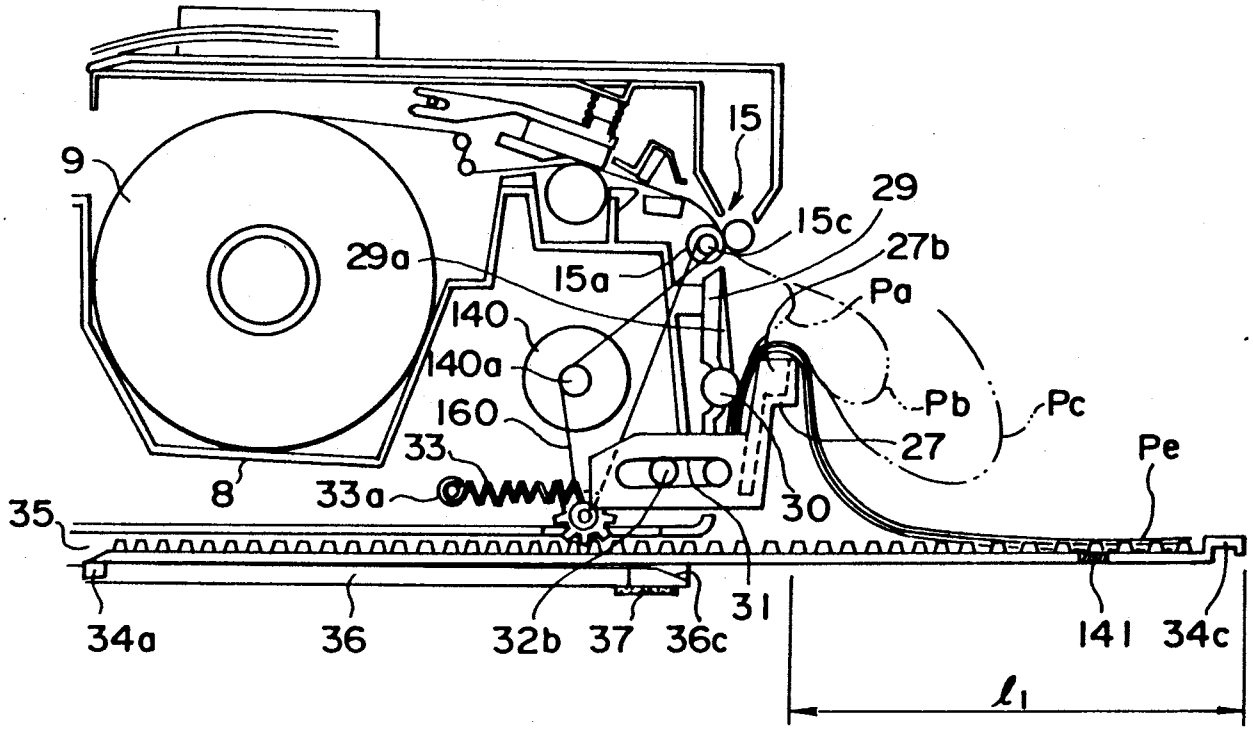
FIG. 16 is an elevational sectional view of a part of the facsimile, showing a condition that a sheet having an intermediate size is being stacked on the second tray.
Figure 17:
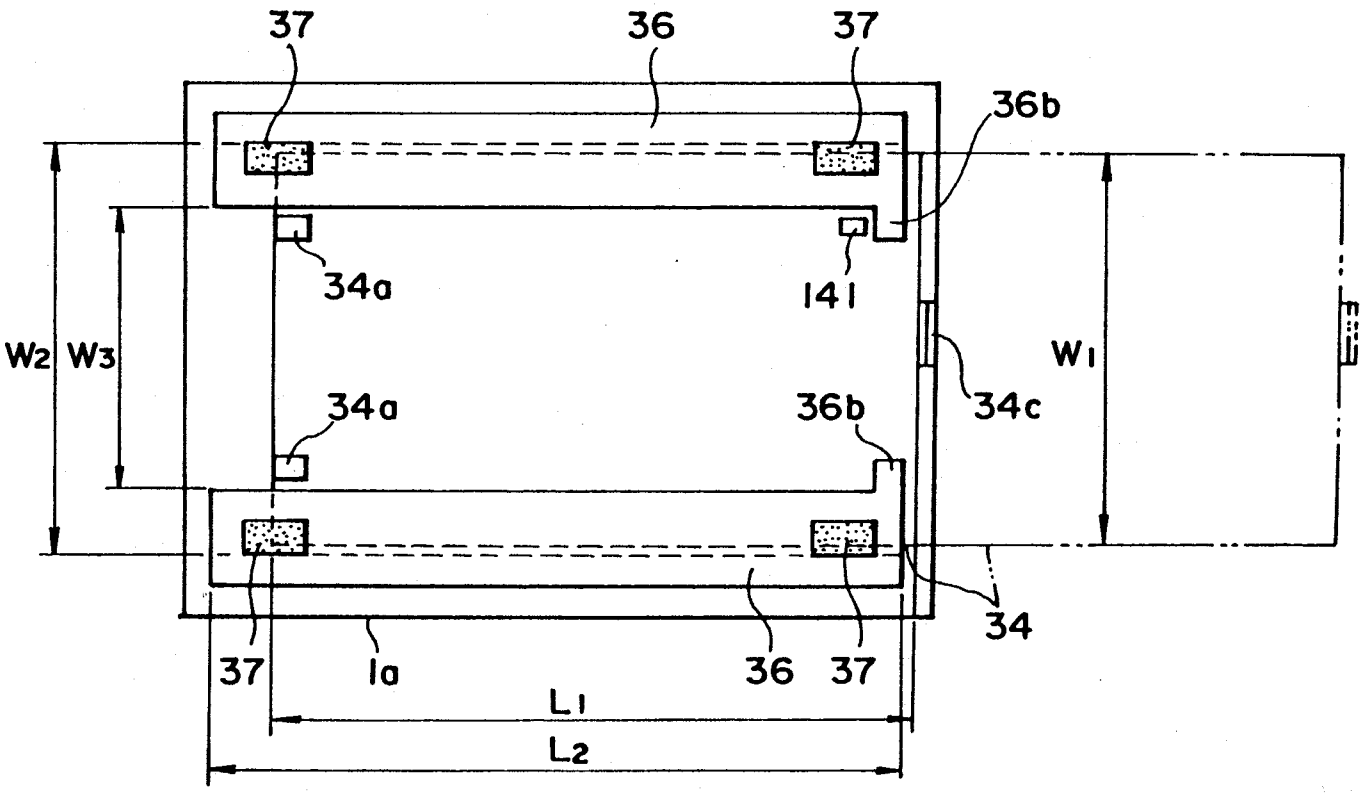
FIG. 17 is a bottom view of the facsimile, showing the construction of a second tray.

First of all, a shifting amount (of the second tray) control (FIG. 20) for setting a shifting amount of the second tray 34 in accordance with the width of the sheet will be explained. When the sheet roll mounted within the roll holder 8 has a width of A*4* size, the width of the sheet is detected by the sheet width detection means 142. When the signal from the sheet width detection means is sent to the CPU 145, the latter rotates the motor 140 in an anti-clockwise direction through the motor driver 146 and turns the electromagnetic clutch 139*a* ON for a predetermined time period corresponding to the width information, with the result that the second tray 34 is extended by a distance $l_1$ and is supported there, as shown in FIG. 16.

Then, the sheet P is ejected from the ejecting rollers 15. After the leading end of the sheet is held by the first tray 26, the sheet P is rested on the second tray 34 in such a manner that the trailing end of the sheet is positioned in the vicinity of the grip 34*c* of the second tray 34 or is abutted against the grip 34*c*.

Figure 18:
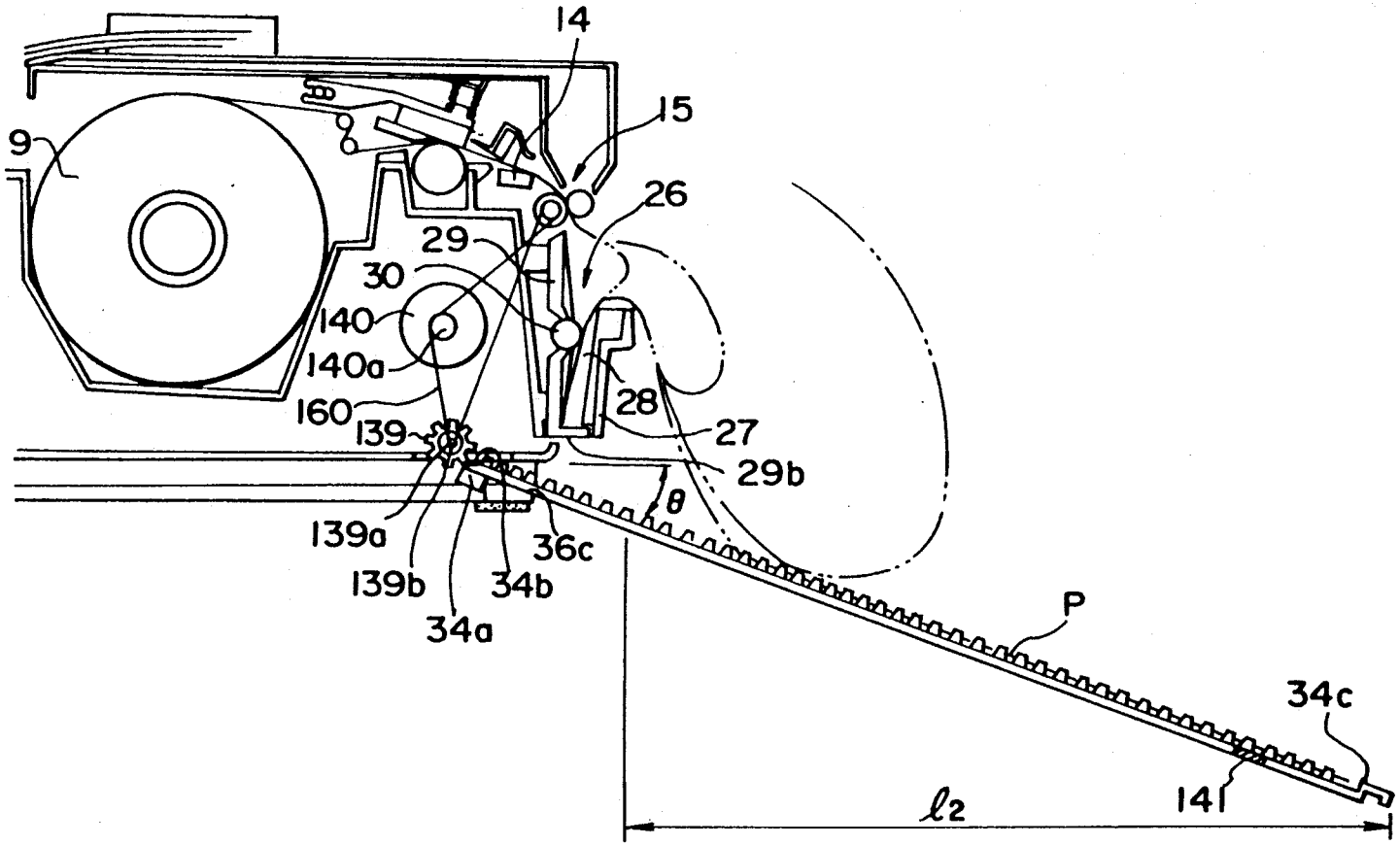
FIG. 18 is an elevational sectional view of a part of the facsimile, showing a condition that a sheet having a large size is stacked on the second tray.

On the other hand, if the sheet roll 9 has a width of B4 size, the second tray 34 is extended from the frame 1*a* by a distance $l_2$ as shown in FIG. 18 and the sheet is rested o the second tray, in the same manner as mentioned above. In the condition shown in FIG. 18, the projections 34*a* of the second tray 34 are engaged by the projections 36*b* of the guide rails 36, and the inclined surface 34*b* of the tray is abutted against the bottom surface of the frame 1*a* and the undersurface of the tray 34 is abutted against the inclined surfaces 36*c* of the guide rails 36, with the result that the tray 34 is inclined by an angle $\theta$ with respect to a horizontal plane. It is desirable that the greater the angle $\theta$ the longer the sheet P.

Next, a shifting amount (of the tray 34) control for setting a shifting amount of the tray in accordance with a length of the ejected sheet P (an intermediate form) will be explained.

Upon activation of the ejecting rollers 15, the number of revolutions sent from the CPU 145 to the motor 140 is counted by the counter 144. The CPU 145 converts the count information into the length of the ejected sheet and turns the electromagnetic clutch 139*a* ON for a time period corresponding to the converted length, thus extending the second tray 34 by a distance corresponding to the length of the sheet to be ejected.

Figure 19:
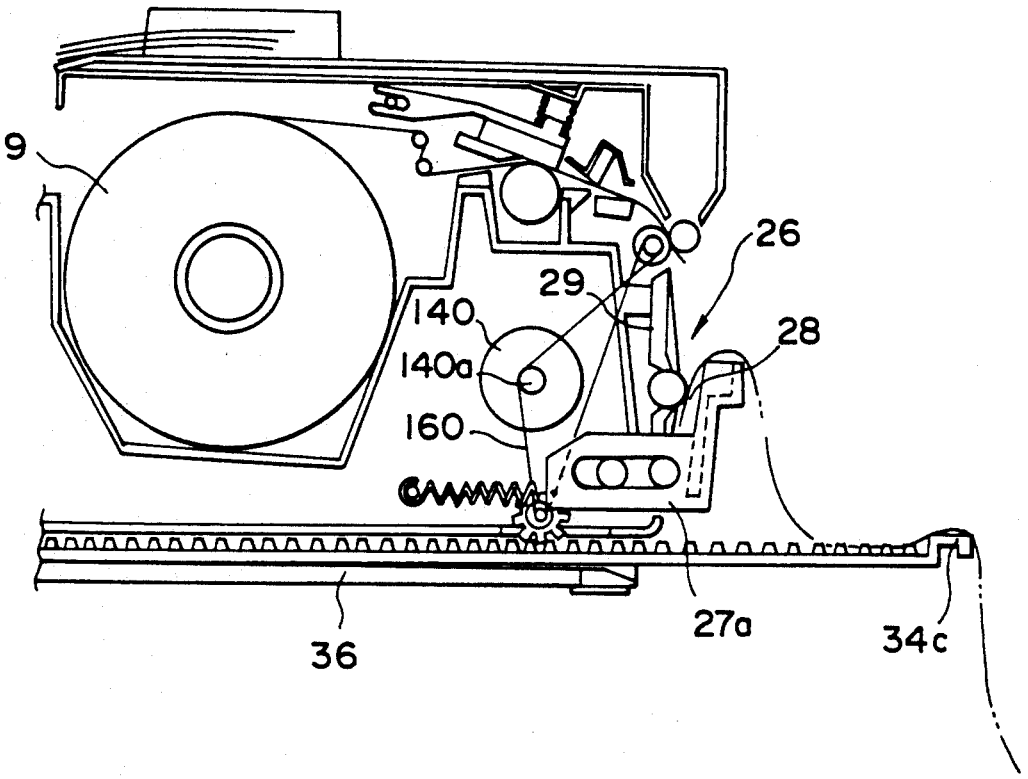
FIG. 19 is an elevational sectional view of a part of the facsimile, showing a condition that a sheet is stacked on the second tray which is extended at a smaller extent.

Further, as shown in FIG. 19, the second tray may be extended by a distance smaller than the distance corresponding to the length of the sheet to be ejected. In this case, since the leading end of the sheet P is held in the first tray 26, so long as only a portion of the sheet is contacted with the second tray 34, the sheet does not drop out from the tray, thus saving the installation space required for the facsimile 1.

Next, an operation for retracting or containing the second tray 34 will be explained.

As mentioned above, the successive sheets P are stably stacked on the second tray 34 with the leading ends thereof being held by the first tray 26 and with the sheets being turned over. After the sheet ejecting operation has been finished, when the operator removes the bundle of the ejected sheets P from the trays 26, 34, the sheet presence detection means 141 generates a sheet absence signal, which is then sent to the CPU 145. When the CPU 145 receives this signal, it turns the electro-magnetic clutch 139*a* ON and rotates the motor 140 reversely by a predetermined amount, thus returning the second tray 34 to the initial or original position as shown in FIG. 15.

On the other hand, during the operation of the ejecting rollers 15, even if the CPU 145 receives the sheet absence signal from the sheet presence detection means 141, the CPU does not rotate the motor 140 reversely, thus maintaining the second tray in the extended position.

Incidentally, while an example that the shifting movement of the tray 34 is started upon the activation of the ejecting rollers 15 was explained, the shifting movement of the second tray 34 may be initiated prior to the activation of the ejecting rollers. Further, the sheet presence detection means 141 may comprise a photo-sensor which detects the presence of the sheet by illuminating light onto the sheet P and determining the presence/absence of the sheet on the basis of the reflected light output, or a mechanical sensor which detects the presence of the sheet P by contacting with the sheet to activate an actuator.

Further, the sheet width detection means 142 may comprise a microswitch. Incidentally, it is desirable that the motor 140 is energized to shift the second tray 34 immediately after the facsimile 1 receives the signal. In this case, since the second tray 34 is extended to the predetermined position prior to the ejection of the sheet P, the sheet can be rested on the second tray without fail.

Further, a plurality of sensors may be used to detect the fact that the tray has reached a desired position, so that the electro-magnetic clutch 139*a* can be turned ON until the desired position of the tray is reached. The guide rails 36 may be integrally formed with the frame 1*a*.

In addition, while the second tray 34 was driven by the rack 138 and pinion 139, the second tray may be driven by a belt/wire mechanism or by a linear motor. Further, if the drive roller 15*a* of the ejecting rollers is connected to the pulley 15*c* through a one-way clutch, even when the motor 140 in rotated in a direction to return the second tray 34, the drive roller 15*a* is not rotated.

Furthermore, while an example that the ejected sheets P are regularly stacked with the leading ends thereof being registered with each other in order by using the first and second trays 26, 34 was explained, the first tray may be omitted. Further, a sliding clutch may be used in place of the electro-magnetic clutch 139*a*. In this case, although the second tray 34 is shifted up to the stopper, the control mechanism can be simplified.

Figure 22:
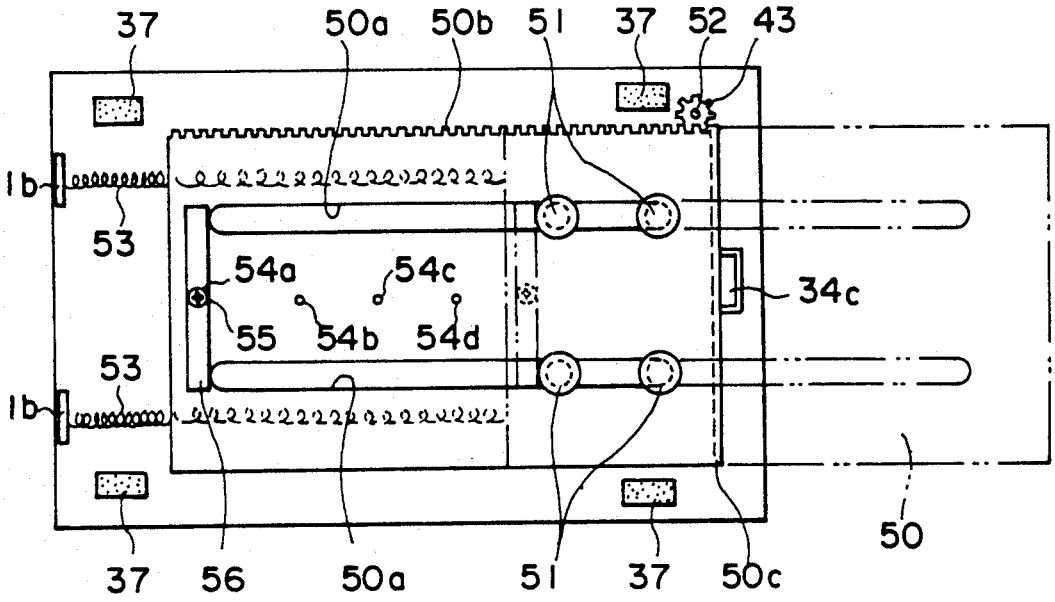
FIG. 22 is a bottom view of the facsimile of FIG. 21, showing the construction of a stacking tray.
Figure 23:
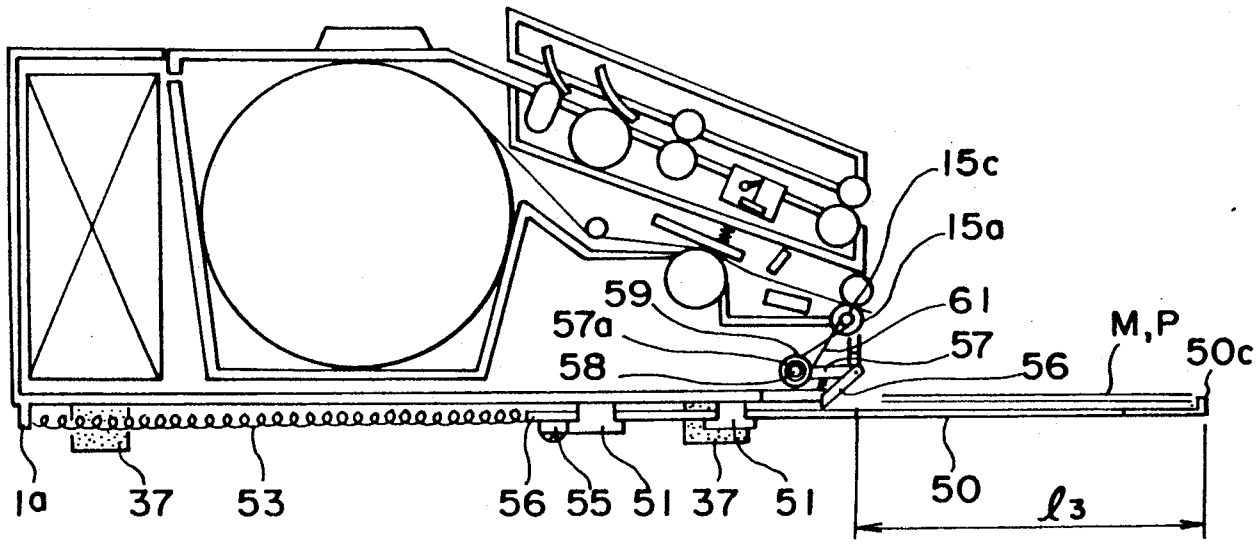
FIG. 23 is an elevational sectional view of a part of the facsimile, showing a condition that a sheet is stacked on the stacking tray.
Figure 24:
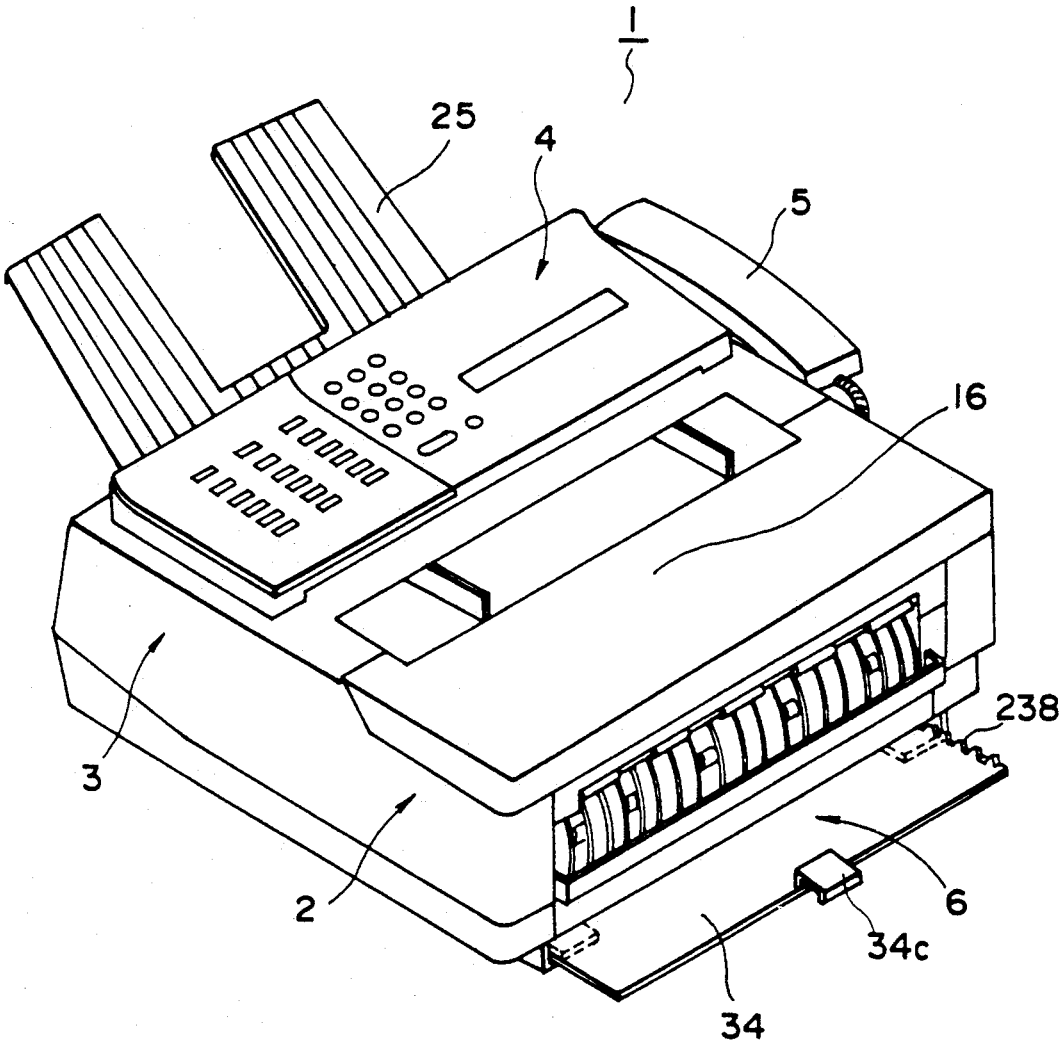
FIG. 24 is a perspective view of a facsimile incorporating an ejected sheet stacking tray system according to a sixth embodiment of the present invention.

Next, the fifth embodiment will be explained with reference to FIGS. 21 to 23.

In this fifth embodiment, there is provided a facsimile 1 wherein the original M and the heat-sensitive sheet P are ejected in the same direction by means of the paired ejecting rollers 20 and 15, respectively. Incidentally, elements having the same function and operation as those shown in the previous embodiments are designated by the same reference numerals and the explanation thereof will be omitted.

A tray 50 is guided by stepped pins 51 formed on a bottom member of the frame 1*a* and longitudinal slots 50*a* formed in the tray 50 and slidably receiving the stepped pins. A rack 50*b* is formed on a right side surface of the tray 50, with which a pinion 43 is meshed. The pinion 43 is rotatably mounted on the frame 1*a* via a rotatable damper 52 attached to the frame. Further, springs 53 connected between the rear end of the tray 50 and brackets 1*b* attached to the frame 1*a* serve to always bias the tray 50 forwardly. Further, a sheet stopper 50*c* is formed on the tray along a front edge thereof.

A plurality of threaded holes 54*a*, 54*b*, . . . , 54*d* are formed in the tray 50 along a center line thereof, and a stopper 56 is attached to the tray via a screw 55 threaded into one of the threaded holes, which stopper is adapted to be engaged, at its both ends, by the stepped pins 51.

Further, an arm 57 is pivotally mounted on a shaft 58 formed on the frame 1*a*, and a ratchet stopper 156 is pivotally connected to a free end of the arm 57 and serves to lock the front end of the tray 50. A pulley 59 is attached to the arm 57 via a sliding clutch 57*a* and a pulley 15*c* is attached to the drive roller 15*a* of the ejecting rollers 15. A belt 61 connects these pulleys 59 and 15*c* in a cross fashion so that the pulley 59 is rotated in a direction opposite to the pulley 15*c*.

Figure 21:
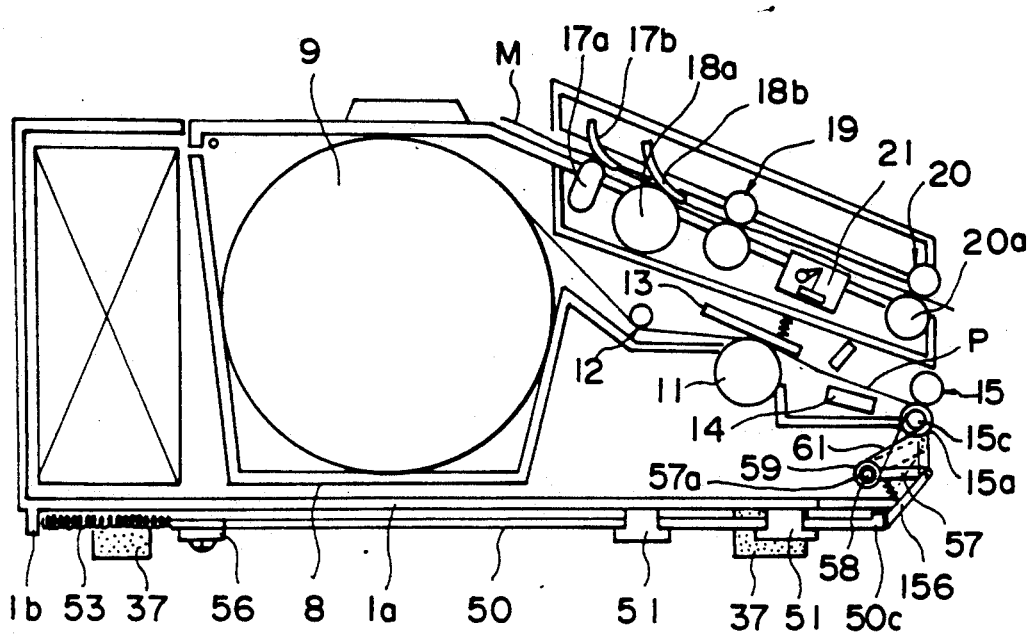
FIG. 21 is an elevational sectional view of a facsimile incorporating an ejected sheet stacking tray system according to a fifth embodiment of the present invention.

In operation, in a waiting condition where the recording or reading operation is not effected, as shown in FIG. 21, the tray is contained in the recessed portion below the frame 1*a* of the facsimile. Since an area of the tray is smaller than a projected area of the frame 1*a*, the tray 50 does not protrude from the frame.

Then, when the recording operation is started, the ejecting drive roller 15*a* is rotated in a clockwise (FIG. 21) direction by the motor, thereby rotating the arm 57 in an anti-clockwise direction through the pulley 15*c*, belt 61, pulley 59 and sliding clutch 57*a*, thus unlocking the tray. Thus, after the arm 57 is rotated by a predetermined amount, it is stopped at a position shown by a broken line while slipping due to the sliding clutch 57*a*.

Then, the unlocked tray 50 is shifted by restoring forces of the springs 53 until the stopper 56 is abutted against the stepped pins 51 to stop. In this case, the rotatable damper 52 is rotated via the pinion 43 meshed with the rack 50*b* of the tray 50. Thus, since the tray 50 is braked by the rotation resistance of the rotatable damper, the tray 50 is smoothly shifted without any shock and/or noise. The ejected originals M are stacked on the tray 50 in order.

When the recording operation is finished, the ejecting drive roller 15*a* is rotated in an anti-clockwise direction to rotate the arm 57 in a clockwise direction, thus abutting the stopper 156 against the upper surface of the tray 50. In this point, when the operator pushes the tray 50 rearwardly for removing the originals M from the tray 50, the stopper 156 is at first abutted against the sheet stopper 50*c* of the tray 50 and then rides over the sheet stopper 50*c*, with the result that the inclined surface of the stopper 156 is engaged by the right end surface of the tray 50. The compression springs 53 are compressed to store the compression force therein for preparing the next extending of the tray 50.

The extended amount $l_3$ of the tray 50 protruding from the frame 1*a* as shown in 23 can be determined without overs and shorts by properly selecting one of the threaded holes 54*a*–54*d* into which the screw 55 is threaded for locking the stopper 56.

Further, when recording operation is performed by using relatively short sheets which are frequently utilized, the extended amount of the tray 50 is reduced by selecting the threaded hole corresponding to the short sheet, thus saving the installation space.

Next, an example that an exclusive motor is used will be explained with reference to FIGS. 24 to 32. Incidentally, the explanation of the same elements as those shown in FIGS. 3 to 13 or FIGS. 14 to 23 will be omitted.

Figure 25:
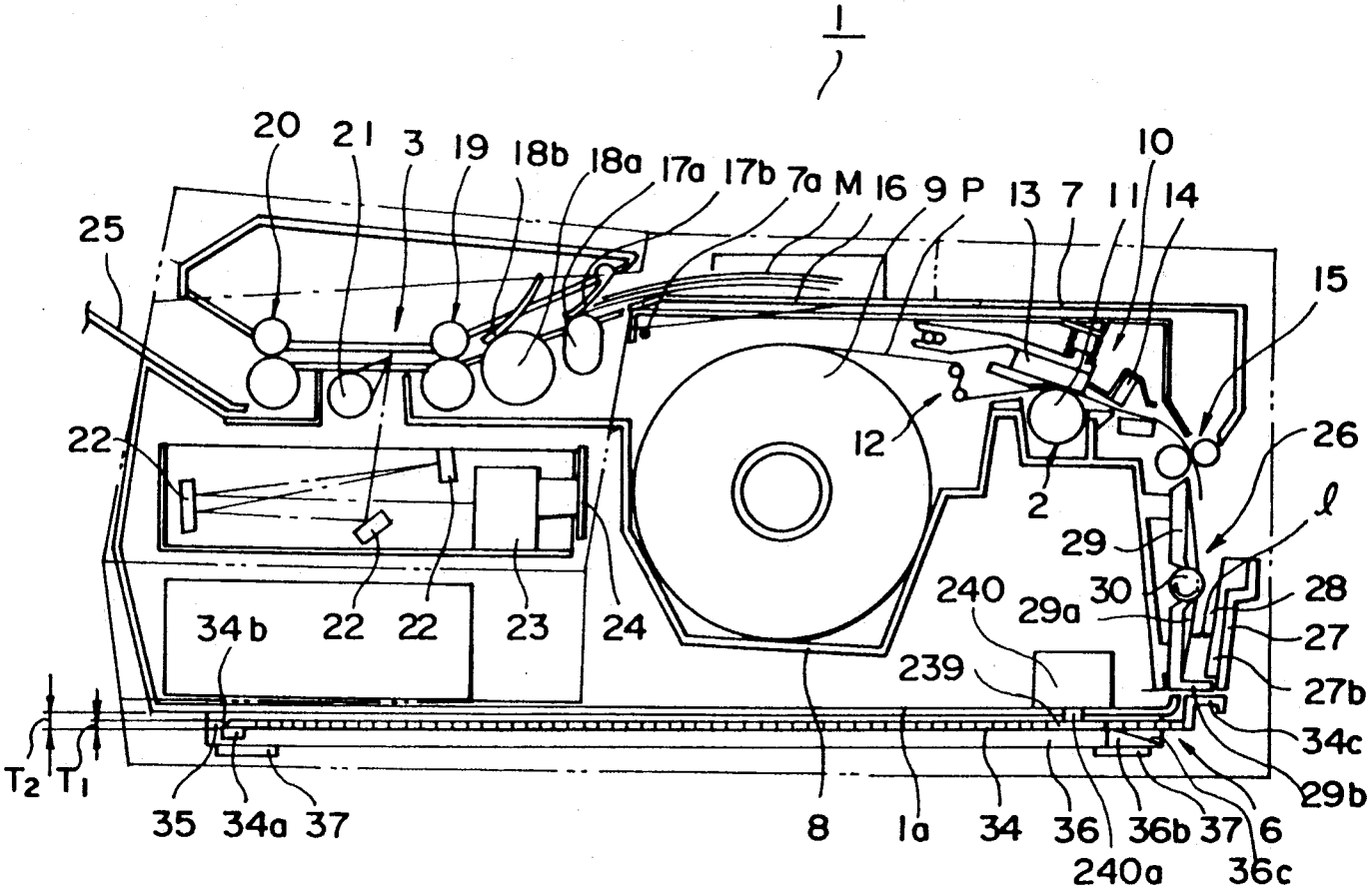
FIG. 25 is an elevational sectional view of the facsimile of FIG. 24.

According to the feature of this example, the left side surface of the second tray 34 is guided inside the longitudinal member of the guide rail 36, and a rack 238 is formed on the right side surface of the second tray 34. As shown in FIG. 25, a pinion 239 meshed with the rack 238 is fixedly mounted on a motor shaft 240*a* of a motor 240 attached to the frame 1*a*. Further, a sensor 241 for detecting the presence of the sheet P is disposed on the front upper surface (sheet receiving surface) of the second tray 34.

Figure 30:
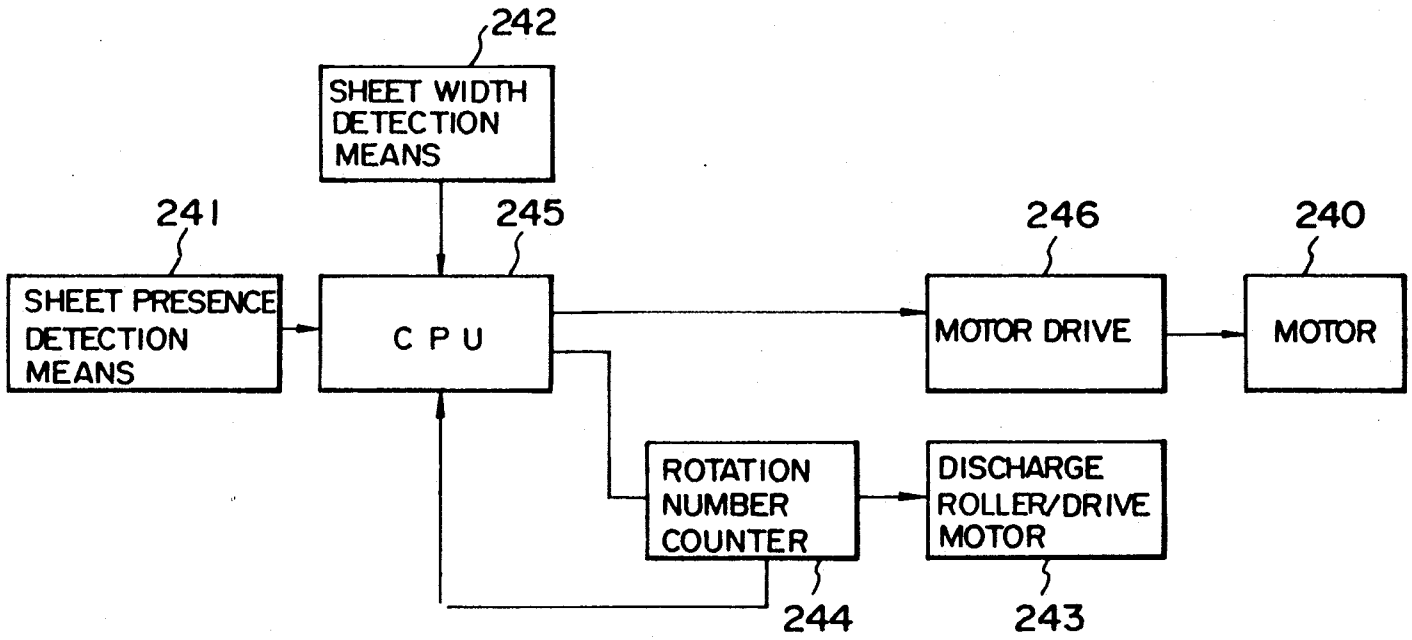
FIG. 30 is a control block diagram.

Next, a control mechanism will be explained with reference to FIG. 30.

It is so designed that signals from a sheet presence detection means 241 for detecting the presence of the sheet, a sheet width detection means 242 and a rotation number counter 244 for counting the number of rotations of a discharge (ejecting) roller drive motor 243 are sent to a CPU 245. In response to these signals, the CPU 245 energizes the motor 240 for driving the second tray 34 via a motor driver 246.

Next, an operation that the heat-sensitive sheets P are stacked on the first tray 26 will be explained.

First of all, when only the first tray 26 is used, the leading end of the sheet P ejected by the ejecting rollers 15 is guided by the ribs 27*b*, 29*a* and then is conveyed by a friction force between the sheet and the gripping roller 30 until the leading end of the sheet (shown as a sheet Pa) is abutted against the sheet receiving portion 29*b* of the stacking cavity 28 having the width of $l_o$, as shown in FIG. 25.

Further, when the sheet is ejected by the ejecting rollers 15, the sheet is under a condition that the leading end of the sheet is abutted against the sheet receiving portion 29*b* shown as a sheet Pa. Then, after the sheet is cut by the cutter 14, when a trailing end of the sheet P leaves the ejecting rollers 15, the sheet falls by its own weight to assume a condition as shown by a sheet P*b* and then to assume a condition as shown by a sheet Pc and at last to reach a condition as shown by a sheet Pe which is rested on the second tray 34. In this condition, the leading end of the sheet is held by the friction force between the sheet and the ribs 29*a*, gripping roller 30 and ribs 27*b*. Incidentally, since the gripping roller 30 is made of rubber, the friction force between this roller and the sheet is great, thus positively holding the sheet Pe.

Then, when a second sheet P is ejected, the second sheet is overlapped with the first sheet P. By ejecting further sheets continuously, when the width $l_o$ of the cavity 28 is fully occupied by the sheets, a next sheet is forcibly pushed between the griping roller 30 and the lastly ejected sheet P by the friction force of the gripping roller 30 rotated substantially in synchronous with the ejecting rollers 15. In this way, the tension springs 33 are extended to increase the pulling force thereof, i.e., to increase the contacting pressure between the sheet P and the gripping roller 30, thus increasing a sheet conveying force of the gripping roller 30, with the result that a large number of sheets can be stacked in the cavity 28 gradually increasing its width l, with the leading ends of the sheets abutted against the sheet receiving portion 29*b*.

Next, an operation that the heat-sensitive sheets P are stacked on the second tray 34 will be explained with reference to FIGS. 25 to 30.

The second tray 34 is pulled out or retracted by activating the motor 240 by any amount between a position where the second tray is contained in the recessed portion 35 as shown in FIG. 15 and a position where the projections 34*a* are abutted against the projections 36*b*.

The number of rotations of the motor 243 for rotating the ejecting roller 15 to eject the heat-sensitive sheet P is counted by the counter 244. In accordance with the count information, the CPU 245 calculates the length of the ejected sheet P and rotates the motor 240 by a desired amount through the motor driver 246 in accordance with the calculated length information, thus extending the second tray 34 by a desired amount.

Further, in the case of a facsimile 1 wherein the sheet material is cut by the cutter 14 to have lengths of B4, A4, B5 and the like in accordance with the width of the heat-sensitive sheet roll 9, in response to the width information from the sheet width detection means 242, the CPU 245 rotates the motor 240 by a predetermined amount through the motor driver 246, thus extending the second tray 34 by a predetermined amount.

Figure 26:
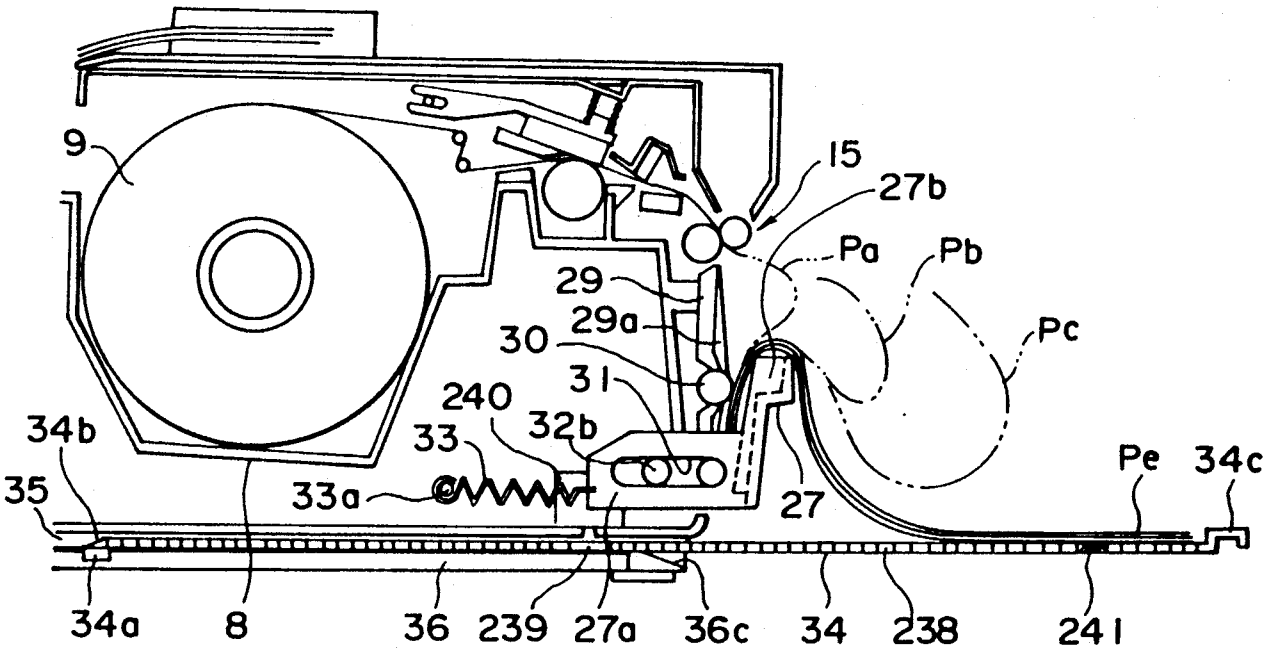
FIG. 26 is an elevational sectional view of a part of the facsimile, showing a condition that a sheet having an intermediate size is being stacked on the second tray.
Figure 27:
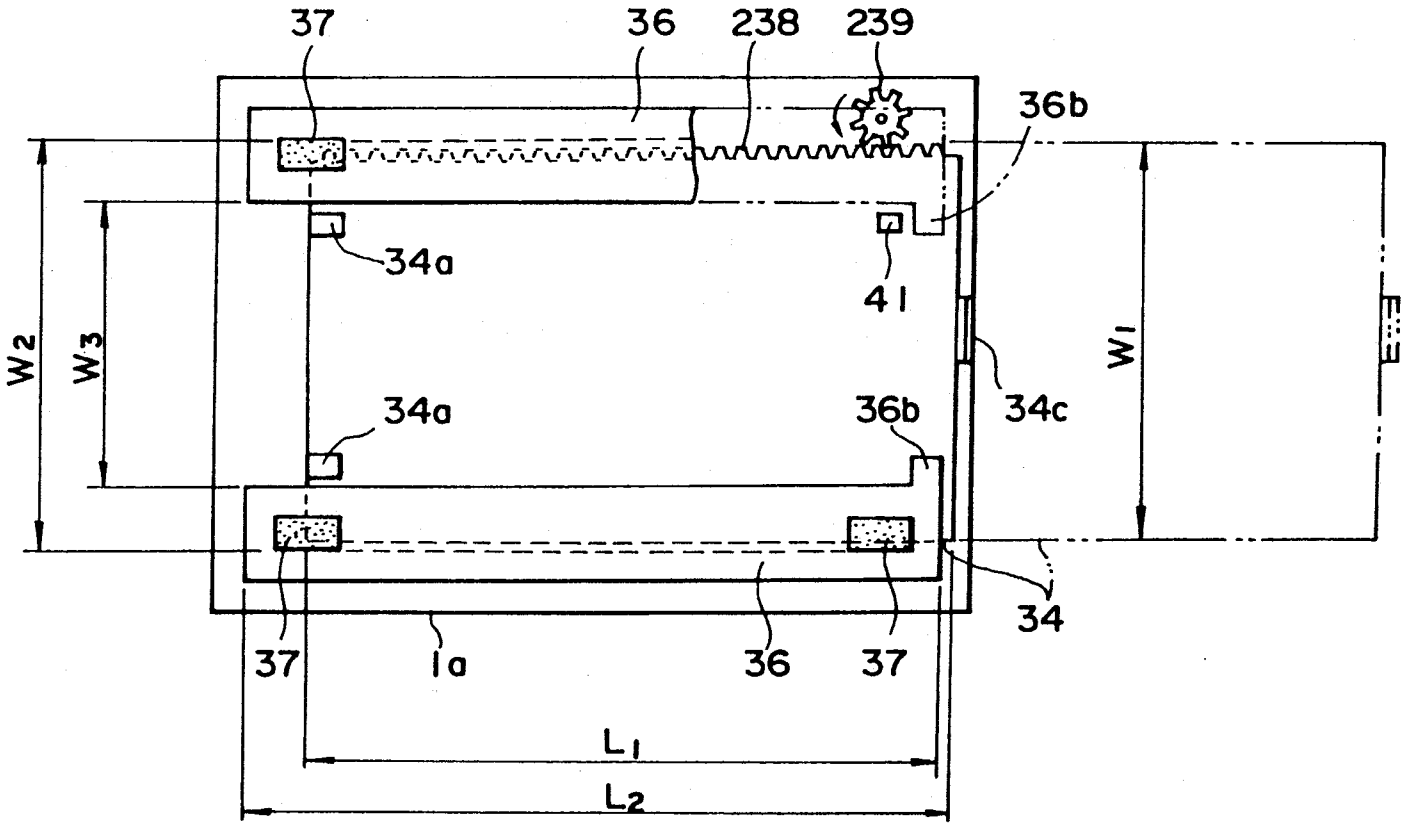
FIG. 27 is a bottom view of the facsimile, showing the construction of a second tray.
Figure 28:
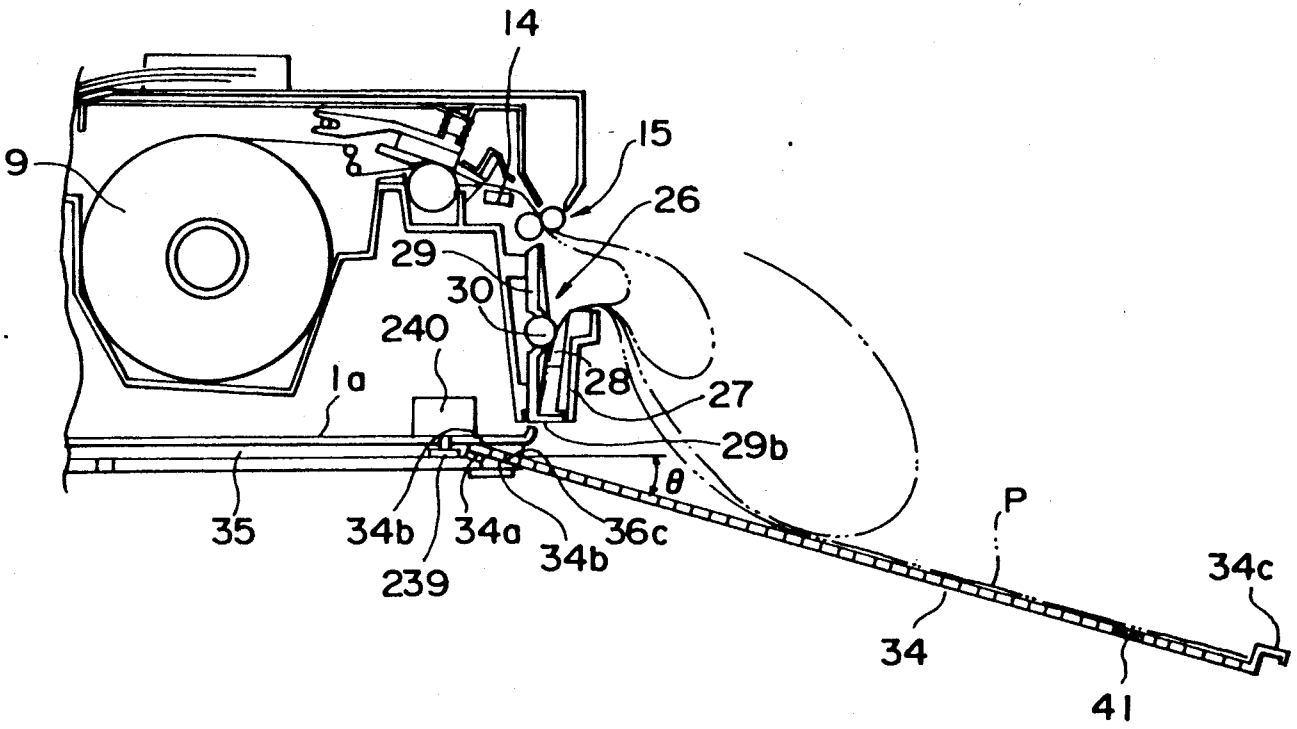
FIG. 28 is an elevational sectional view of a part of the facsimile, showing a condition that a sheet having a large size is stacked on the second tray.

For example, a condition shown in FIG. 26 may be a condition corresponding to the sheet having a size of A4, and a condition shown in FIG. 28 may be a condition corresponding to the sheet having a size of B4. In the condition shown in FIG. 28, the projections 34*a* of the second tray 34 are engaged by the projections 36*b* of the guide rails 36, and the inclined surface 34*b* of the tray is abutted against the bottom surface of the frame 1*a* and the undersurface of the tray 34 is abutted against the inclined surfaces 36*c* of the guide rails 36, with the result that the tray 34 is inclined by an angle $\theta$ with respect to a horizontal plane. In this case, the trailing end of the sheet P of B4 size is positioned in the vicinity of the grip 34*c* of the tray 34.

Figure 29:
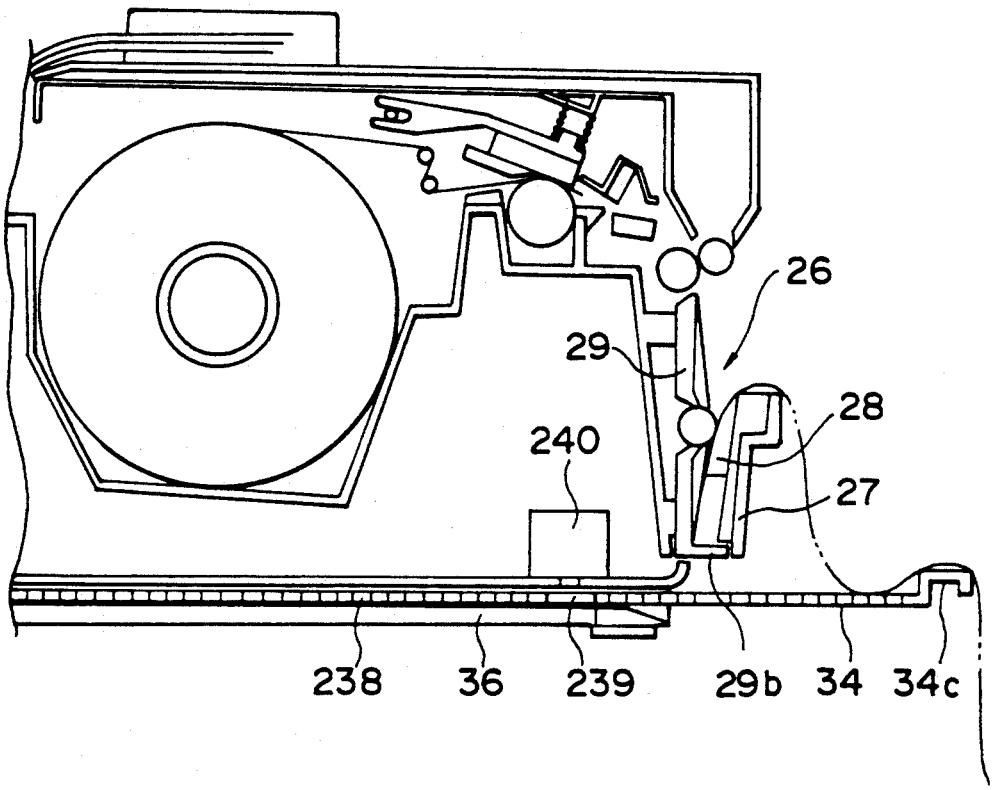
FIG. 29 is an elevational sectional view of a part of the facsimile, showing a condition that a sheet is stacked on the second tray which is extended at a smaller extent.

Further, as shown in FIG. 29, the second tray 34 may be extended by a distance smaller than the distance corresponding to the length of the sheet to be ejected. In this case, since the leading end of the sheet P is held in the first tray 26, so long as only a portion of the sheet is contacted with the second tray 34, the sheet does not drop out from the tray, thus saving the installation space required for the facsimile 1.

In this way, as shown in FIGS. 26 and 28, since the sheets P are stacked on the second tray 34 with the trailing ends thereof positioned in the vicinity of the grip 34*c*, the sheets can be stably stacked without overlapping the trailing ends thereof and with the sheets being turned over. Further, even if the size of the sheet P is varied, the extended amount of the second tray 34 can be adjusted without overs and shorts so that the sheets P can be stacked as shown in FIGS. 26 and 28.

Then, when the operator removes the ejected heat sensitive sheets P from the tray 34, the sheet presence detection means (sensor) 241 generates a sheet absence signal, which is then sent to the CPU 245. When the CPU 245 receives this signal, it rotates the motor 240 reversely by a predetermined amount, through the motor driver 246, thus returning the second tray 34 to the initial or original position in the recessed portion 35. Thus, the second tray is waiting for the next recording operation. However, during the ejection of the sheet P (during the operation of the ejecting rollers 15), even if the CPU 245 receives the sheet absence signal from the sheet presence detection means 241, the CPU does not rotate the motor 240 reversely, thus maintaining the second tray 34 in the extended position.

Incidentally, when the longer sheet P is used, the inclined angle $\theta$ shown in FIG. 28 may be increased. The motor 240 may be rotated substantially in synchronous with the drive motor 243 for the ejecting rollers 15. As shown in FIG. 29, the required installation space may be reduced by decreasing the extended amount of the second tray 34.

Further, the motor 240 may be energized to shift the second tray 34 immediately after the facsimile 1 receives the signal. While an example that the shifting amount of the second tray 34 is controlled by rotating the motor 240 by the pre-selected revolutions was explained, the motor 240 may be controlled by a plurality of sensors capable of detecting the fact that the tray reaches a desired position.

Figure 31:
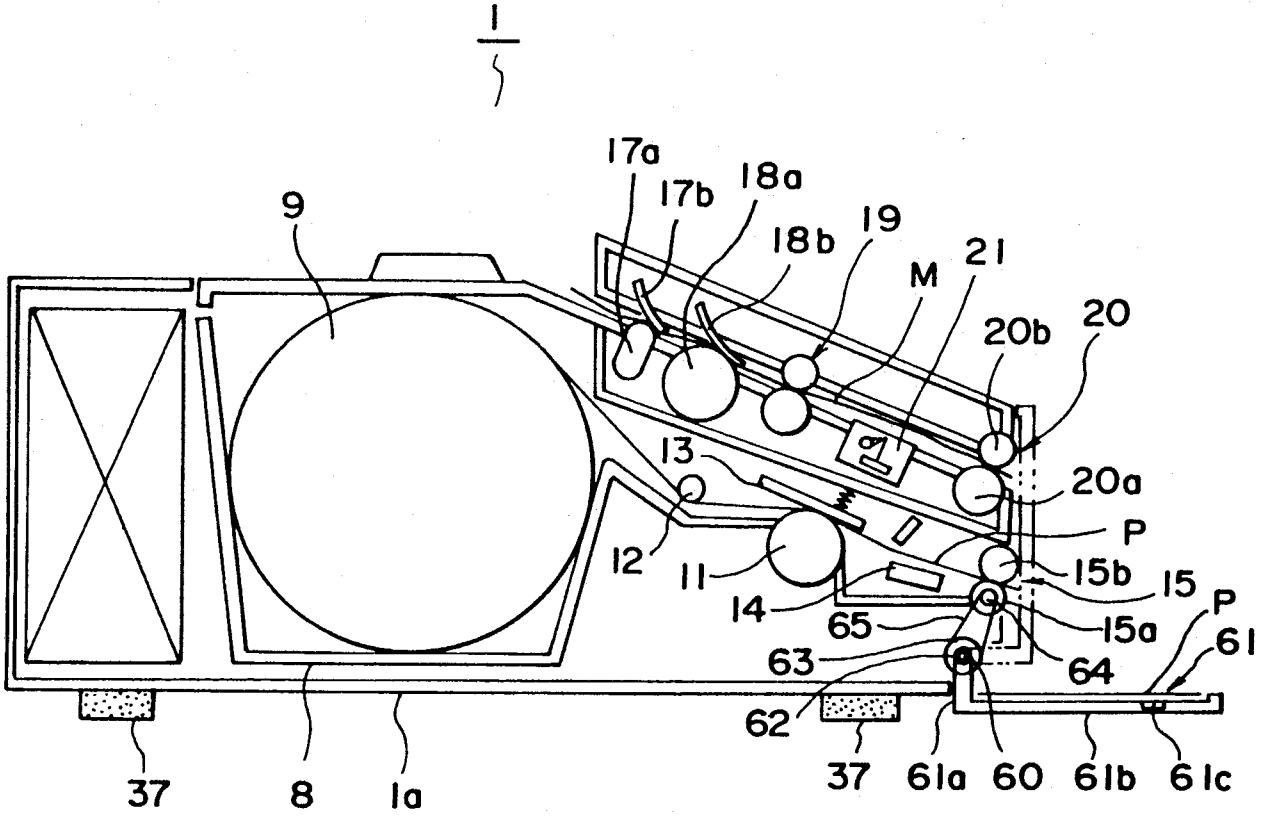
FIG. 31 is an elevational sectional view of a facsimile incorporating an ejected sheet stacking tray system according to a seventh embodiment of the present invention.

Next, a seventh embodiment will be explained with reference to FIG. 31.

This embodiment provides a facsimile 1 wherein both the original M and the heat-sensitive sheet P are ejected in the same direction by the paired ejecting rollers 20 and 15, respectively. Incidentally, elements same as those shown in the previous embodiments are designated by the same reference numerals and the explanation thereof will be omitted.

The pair of ejecting rollers 15 comprise the above-mentioned drive roller 15*a* and a driven roller 15*b*, and the pair of ejecting rollers 20 comprise a drive roller 20*a* and a driven roller 20*b*. Further, below the frame 1*a* at the front part thereof, there is provided a shaft 60 to which an L-shaped tray 61 is attached. When the tray 61 is rotated in a clockwise direction until a base end 61*a* of the tray 61 is abutted against a front end of the bottom of the frame 1*a*, a tray portion 61*b* of the tray 61 is maintained substantially in a horizontal condition; whereas, when the tray 61 is rotated in an anti-clockwise direction, the tray portion 61*b* of the tray 61 is cocked uprightly to cover the right sides of the ejecting rollers 15*a*, 15*b* and ejecting rollers 20*a*, 20*b*, as shown by the phantom line.

A pulley 63 is attached to the shaft 60 via an electro-magnetic clutch 62, and a pulley 64 is attached to a shaft of the drive roller 15*a* of the ejecting rollers 15, there pulleys being connected to each other through a belt 65. Further, a sheet presence detection means 61*c* for detecting the presence/absence of the sheet P is disposed on the tray portion 61*b* of the tray 61.

Next, an operation of this embodiment (FIG. 31) will be explained with reference to a flow chart shown in FIG. 32.

First of all, when the recording operation is started (step S1), the ejecting drive roller 15*a* is rotated in the clockwise direction (normal direction) (step S2), thus preparing for the ejection of the sheet P. In this case, the sheet presence detection means 61*c* determines whether the sheet P exists on the tray portion 61*b* (step S3). If the sheet is present, since the tray 61 is positioned in a position shown by the solid line and the sheet is rested on the tray, the electro-magnetic clutch 62 is turned OFF (step S4), with the result that the tray 61 is not pivoted and the sheet P is rested on the tray 61 by the rotation of the drive roller 15*a* (step S5), thus finishing the recording operation (step S6).

On the other hand, in the step S3, if the sheet is absent, since the tray 61 is positioned in a position shown by the phantom line, the electro-magnetic clutch 62 is turned ON for the predetermined time period (step S7), thus rotating the drive roller 15*a* in the normal direction, with the result that tray 61 is pivoted in the clockwise direction from the phantom line position to the solid line position through the pulley 65, pulley 63 and clutch 62 (step S8). Then, the ejected sheet P is supported in the sheet receiving position, and, thereafter, the electro-magnetic clutch 62 is turned OFF (step S4), thus resting the sheet on the tray (step S5).

Further, the detection of the presence of the sheet is effected even after the recording operation is finished (step S9); if the sheet is present, the electro-magnetic clutch 62 is maintained in the OFF condition and the tray 61 is maintained in the extended position, and, thus, a waiting condition is attained to prepare for the next recording operation (step S10).

On the other hand, the operator removes the sheets P from the tray 61, the absence of the sheet is confirmed in the step S9. In this case, if the sheet is not being ejected, the electromagnetic clutch 62 is turned ON (step S11), thus rotating the drive roller 15*a* reversely (step S12). Consequently, the tray 61 is rotated in the anti-clockwise direction (step S13). Then, when the drive roller 15*a* is rotated by the predetermined amount, it is stopped and the electro-magnetic clutch 62 is turned OFF (step S14). At this point, the tray 61 is positioned in the phantom line position (i.e., is supported in the position where the tray covers the paired ejecting rollers 15 and 20), thus attaining a waiting condition to prepare for the next recording operation (step S10).

In this way, by permitting the tray 61 to be retracted, the protruded portion of the facsimile system can be eliminated, thereby improving the appearance of the facsimile and reducing the installation space required for the facsimile.

Further, since the rotation of the drive roller 15*a* can be selectively transmitted to the tray 61 by means of the electro-magnetic clutch 62, a motor for driving the tray 61 can be omitted, thus reducing the cost.

Incidentally, while an example that the tray 61 is driven by the drive roller 15*a* was explained, the tray may be driven by the drive roller 20*a*.

What is claimed is:

1. An ejected sheet stacking tray apparatus comprising:

ejecting means for ejecting downward a sheet on which an image is formed;

first tray means, having a vertically extending portion, which pinches a leading end of the sheet ejected by said ejecting means, and having an outer side wall for supporting the sheet, wherein the trailing end of the sheet is suspended outwardly of said outer side wall while the leading edge is pinched by said first tray means; and second tray means disposed below said first tray, said second tray means being shiftable between an operative position, where the trailing end of the sheet outwardly suspended can be stacked thereon, and an inoperative position, wherein said second tray means is contained within said tray apparatus.

2. An ejected sheet stacking tray apparatus according to claim 1, wherein said second tray means is guided in such a manner that it can be manually extended and retracted and includes a positioning means for adjusting an extended amount of said second tray means.

3. An ejected sheet stacking tray apparatus according to claim 2, wherein said second tray means is normally guided in a horizontal condition, and is inclined downwardly when it is extended to a maximum extent.

4. An ejected sheet stacking tray apparatus according to claim 1, further including an electrically-operated means for shifting said second tray means.

5. An ejected sheet stacking tray apparatus according to claim 4, further comprising detection means for detecting the presence of the sheet on said tray means; and control means for detecting whether said tray means exists at said operative position or not, upon initiation of an ejecting operation by confirming the presence or absence of the sheet by means of said detection means, and for shifting said tray means to said operative position by activating said electrically-operated means when the sheet is absent on said tray means.

6. An ejected sheet stacking tray apparatus according to claim 4, further including a detection means for detecting the presence of the sheet on said second tray means, and wherein said second tray means is shifted to said inoperative position by controlling said electrically-operated means when the sheet is absent on said second tray means.

7. An ejected sheet stacking tray apparatus according to claim 4, further including a control means for controlling said electrically-operated means in accordance with a size of the sheet.

8. An ejected sheet stacking tray apparatus according to claim 4, further including a measurement means for measuring a rotating amount of said ejecting means, and wherein said electrically-operated means is controlled by a value measured by said measurement means.

9. An ejected sheet stacking tray apparatus according to claim 1, further comprising, biasing means for biasing said tray means toward said operative position;

holding means for holding said tray means in said inoperative position in opposition to a biasing force of said biasing means;

rotary means for ejecting the sheet onto said tray means; and releasing means for releasing the holding of said tray means by means of said holding means, in synchronous with a rotation of said rotary means.

10. An ejected sheet stacking tray system according to claim 9, further including a damper means for braking the shifting of said tray means effected by said biasing means.

11. An ejected sheet stacking tray system according to claim 10, wherein said tray means is reciprocally slid substantially in a horizontal direction.

12. An ejected sheet stacking tray apparatus according to claim 1, further comprising rotary means for ejecting the sheet onto said tray means;

electrically-operated means for driving said rotary means; and shifting means for shifting said tray means via said electrically-operated means.

13. An ejected sheet stacking tray system according to claim 12, wherein said tray means is pivotally supported.

14. An ejected sheet stacking tray system according to claim 12, further including a detection means for detecting whether the sheet exists on said tray means or not, and a control means for shifting said tray means through said shifting means when the sheet does not exist on said tray means upon the rotation of said rotary means by means of said electrically-operated means.

15. An image forming apparatus, comprising:

an image forming portion for forming an image on a sheet surface;

ejecting means for ejecting downward a sheet on which an image is formed;

first tray means, having a vertically extending portion, which pinches a leading end of the sheet ejected by said ejecting means, and having an outer side wall for supporting the sheet, wherein the trailing end of the sheet is suspended outwardly of said outer side wall while the leading edge is pinched by said first tray means; and second tray means disposed below said first tray, said second tray means being shiftable between an operative position, where the trailing end of the sheet outwardly suspended can be stacked thereon, and an inoperative position, wherein said second tray means is contained within said image forming apparatus.

16. An image forming apparatus according to claim 15, wherein said image forming apparatus is a facsimile apparatus provided with image forming means for forming an image on the basis of a received image signal, shifting means for shifting said second tray means form said inoperative position to said operative position in response to said received image signal.

17. A facsimile apparatus according to claim 16, wherein said shifting means includes an electrically-operated means for reciprocally moving said second tray means.

* * * * *

UNITED STATES PATENT AND TRADEMARK OFFICE

CERTIFICATE OF CORRECTION

PATENT NO. : 5,251,890

DATED : October 12, 1993

INVENTOR(S) : KEIZO SASAI

It is certified that error appears in the above-identified patent and that said Letters Patent is hereby corrected as shown below:

ON TITLE PAGE

AT [57] ABSTRACT, Line 8, "shift" should read --to shift--.

SHEET 29 OF 29

Figure 32:
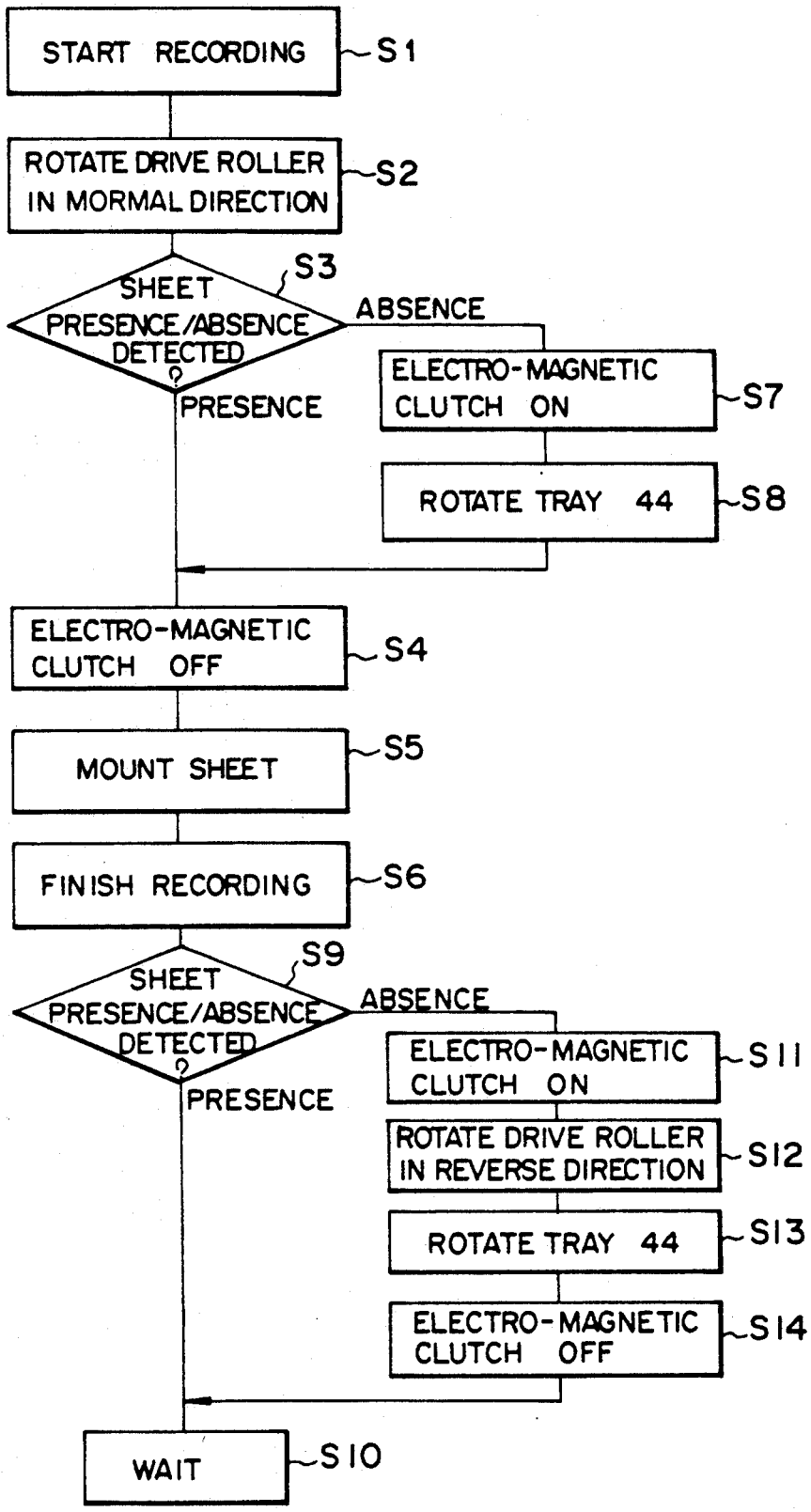
FIG. 32 is a flow chart for explaining an operation of the facsimile.

FIG. 32, "MORMAL" should read --NORMAL--.

COLUMN 1

Line 59, "been" should be deleted.

COLUMN 2

Line 5, "against of" should read --against--.
Line 41, "synchronous" should read --synchronism--.

COLUMN 4

Line 23, "mounted" should read --mounted on--.
Line 67, "donw-" should read --down- --.

COLUMN 5

Line 18, "synchronous" should read --synchronism--.
Line 20, "a respec-" should read --a plurality of vertical ribs 27b and 29a are formed, respec- --.
Line 55, "portion 35, so" should read --portion 35.--.
Line 56 should be deleted.
Line 57, "cessed portion 35." should be deleted.

--

UNITED STATES PATENT AND TRADEMARK OFFICE

CERTIFICATE OF CORRECTION

PATENT NO. : 5,251,890

DATED : October 12, 1993

INVENTOR(S) : KEIZO SASAI

It is certified that error appears in the above-identified patent and that said Letters Patent is hereby corrected as shown below:

COLUMN 6

Line 41, "synchronous" should read --synchronism--.
Line 61, "clicks" should read --click--.

COLUMN 7

Line 25, "facsiimle 1." should read --facsimile 1.--.

COLUMN 8

Line 4, "position a" should read --position as--.
Line 14, "synchronous" should read --synchronism--.
Line 31, "15aconstituting" should read --15a constituting--.

COLUMN 9

Line 7, italics should be deleted.
Line 30, "synchronous" should read --synchronism--.

COLUMN 10

Line 2, "o" should read --on--.
Line 50, "CPU" should read --CPU 145--.

COLUMN 12

Line 23, "stopper 156" should read --stopper 56--.
Line 26, "stopper 156" should read --stopper 56--.
Line 29, "stopper 156" should read --stopper 56--.
Line 34, "23" should read --FIG. 23--.

--

UNITED STATES PATENT AND TRADEMARK OFFICE

CERTIFICATE OF CORRECTION

PATENT NO. : 5,251,890

DATED : October 12, 1993

INVENTOR(S) : KEIZO SASAI

It is certified that error appears in the above-identified patent and that said Letters Patent is hereby corrected as shown below:

COLUMN 13

Line 33, "synchronous" should read --synchronism--.

COLUMN 14

Line 48, "nous" should read --nism--.

COLUMN 15

Line 18, "there" should read --these--.
Line 58, "the operator" should read --when the operator--.

COLUMN 16

Line 29, "first tray," should read --first tray means,--.
Claim 5, "said tray means" (all occurrences) should read --said second tray means--.

COLUMN 17

Claim 9, "said tray means" (all occurrences) should read --said second tray means--.
Line 7, "comprising," should read --comprising:--.
Line 17, "nous" should read --nism--.
Line 18, "system" should read --apparatus--.
Line 22, "system" should read --apparatus--.
Line 26, "comprising" hsould read --comprising:--.
Line 33, "system" should read --apparatus--.
Line 36, "system" should read --apparatus--.

--

UNITED STATES PATENT AND TRADEMARK OFFICE

CERTIFICATE OF CORRECTION

PATENT NO. : 5,251,890

DATED : October 12, 1993

INVENTOR(S) : KEIZO SASAI

It is certified that error appears in the above-identified patent and that said Letters Patent is hereby corrected as shown below:

COLUMN 18

Line 18, "first tray," should read --first tray means,--.
Line 29, "nal," should read --nal, and--.
Line 31, "form" should read --from--.
Line 33, "A facsimile apparatus" should read --An image forming apparatus--.

Signed and Sealed this

Twenty-sixth Day of July, 1994

Bruce Lehman

*Attest:*

BRUCE LEHMAN

*Attesting Officer*

*Commissioner of Patents and Trademarks*

--